US008606164B2

(12) United States Patent
Uekawa et al.

(10) Patent No.: US 8,606,164 B2
(45) Date of Patent: Dec. 10, 2013

(54) ROTATABLE IMAGE HEATING MEMBER AND IMAGE HEATING DEVICE

(75) Inventors: Eiji Uekawa, Susono (JP); Akihito Kanamori, Yokohama (JP); Yusuke Jota, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 13/190,759

(22) Filed: Jul. 26, 2011

(65) Prior Publication Data

US 2012/0027479 A1 Feb. 2, 2012

(30) Foreign Application Priority Data

Jul. 28, 2010 (JP) ..... 2010-169159

(51) Int. Cl.
*G03G 15/20* (2006.01)

(52) U.S. Cl.
USPC ..... 399/330; 399/333

(58) Field of Classification Search
USPC ..... 399/330, 333
See application file for complete search history.

(56) References Cited

U.S. PATENT DOCUMENTS

| | | | | |
|---|---|---|---|---|
| 6,085,059 | A * | 7/2000 | Haneda et al. | 399/333 |
| 6,731,902 | B2 | 5/2004 | Takenaka et al. | |
| 7,203,438 | B2 | 4/2007 | Omata et al. | |
| 7,215,899 | B2 | 5/2007 | Kimizuka et al. | |
| 7,251,447 | B2 | 7/2007 | Kanamori et al. | |
| 7,452,594 | B2 * | 11/2008 | Pickering | 428/323 |
| 7,518,089 | B2 | 4/2009 | Hashiguchi et al. | |
| 2003/0063934 | A1 * | 4/2003 | Takenaka et al. | 399/333 |
| 2005/0226661 | A1 * | 10/2005 | Ohmura et al. | 399/333 |
| 2005/0276633 | A1 * | 12/2005 | Ueda et al. | 399/159 |
| 2006/0008304 | A1 * | 1/2006 | Kitano | 399/333 |
| 2008/0112736 | A1 * | 5/2008 | Kimura | 399/328 |
| 2012/0076555 | A1 * | 3/2012 | Ikegami et al. | 399/328 |

FOREIGN PATENT DOCUMENTS

| | | |
|---|---|---|
| JP | 2003-091192 | 3/2003 |
| JP | 2007-328020 | 12/2007 |

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image heating device includes a rotatable image heating member including an elastic layer and a surface layer in which a filler is dispersed; and a fixed pressing member which is contacted to a surface of the rotatable image heating member and forms a nip, between itself and the rotatable image heating member, in which a recording material for carrying an image is to be nip-conveyed. The surface of the rotatable image heating member has a shape such that projections are distributed by the filler so that a coefficient of dynamic friction μ(hot) relative to said fixed pressing member when a surface temperature of the rotatable image heating member is a temperature during image heating and a coefficient of dynamic friction μ(cold) relative to the fixed pressing member when the surface temperature is a normal temperature satisfy, $$\mu(\text{hot}) < 1.2 \times \mu(\text{cold}).$$

14 Claims, 8 Drawing Sheets

(a)

(b)

(a)

(b)

(a)

(b)

ROTATABLE IMAGE HEATING MEMBER AND IMAGE HEATING DEVICE

FIELD OF THE INVENTION AND RELATED ART

The present invention relates to a rotatable image heating member for heating an image on a recording material and relates to an image heating device.

As the image heating device, e.g., a fixing device for heat-fixing an unfixed image on the recording material or a glossiness increasing device (image modifying device) for increasing glossiness of an image by heating the image fixed on the recording material is used. The rotatable image heating member is a roller-like or endless belt-like rotatable member, for heating the image in contact with an image formed surface of the recording material, by being externally or internally heated by a heating means.

For example, as a heat-fixing device which is the image heating device to be mounted in an image forming apparatus, such as a copying machine or an LBP, in which an image forming process of an electrophotographic type, an electrostatic recording type or the like is employed, there have been known devices of various types and constitutions.

One of the present inventors has proposed in Japanese Laid-Open Patent Application (JP-A) 2007-328020, as a constitution of the heat-fixing device simplified for the purpose of reduction in cost and size, a device of a pressing member-fixed type. This device uses a non-rotational fixing member such as a pressing pad or a pressing sheet as a pressing member press-contacted to a fixing roller as a rotatable image heating member to form a fixing nip in which a recording material is to be nip-conveyed. Further, JP-A 2003-91192 discloses a fixing device in which a sheet-like pressing member having a leaf spring property if contacted to the fixing roller and recording paper (recording material) on which a toner image is transferred is heated and pressed when being passed between the fixing roller and the sheet-like pressing member, thus fixing the toner image on the recording paper.

In such a heat-fixing device of the pressing member-fixed type, the pressing member which is the non-rotational fixing member constitutes a conveyance resistance of the recording material in the nip. Therefore, for the surface of the pressing member, a material having a small friction coefficient is selected, and for the surface of the fixing roller, a material having a large friction coefficient is selected. As a result, the recording material is conveyed while slides on the surface of the pressing member at its back surface. Specifically, for the surface of the fixing roller, a material such as silicone rubber with a strong tack property is used or a material for increasing a frictional force is contained, as a filler, in fluorine-containing resin.

However, when a friction coefficient μ of the fixing roller surface is high, the fixing roller surface and the pressing member surface directly rub with each other, so that the frictional force becomes very large. In order to rotate the fixing roller with the large frictional force, a rotational torque is increased and therefore a motor with a large output is required in order to generate power therefor. Although the pressing member is fixed for reducing the cost and the size, when the output of the motor is increased, the cost is correspondingly increased and the size of the motor is also increased, so that an intended purpose cannot be achieved.

SUMMARY OF THE INVENTION

The present invention provides a further development of the above-described conventional constitutions.

A principal object of the present invention is to provide a rotatable image heating member capable of stably conveying a recording material while suppressing a rotational torque by suppressing a frictional force of a surface layer of the rotatable image heating member of an image heating device of a pressing member-fixed type against a pressing member.

Another object of the present invention is to provide the rotatable image heating member capable of using a driving motor with a smaller output by suppressing the frictional force of the surface layer of the rotatable image heating member against the pressing member to suppress the rotational torque.

A further object of the present invention is to provide the image heating device of the pressing member-fixed type using the rotatable image heating member capable of stably conveying the recording material while suppressing the rotational torque by suppressing the frictional force of the surface layer of the rotatable image heating member against the pressing member.

A still further object of the present invention is to provide the image heating device of the pressing member-fixed type capable of using the driving motor with the small output to reduce cost and size by suppressing the frictional force of the surface layer of the rotatable image heating member against the pressing member to suppress the rotational torque.

According to an aspect of the present invention, there is provide an image heating device comprising:

a rotatable image heating member including an elastic layer and a surface layer in which a filler is dispersed; and a fixed pressing member which is contacted to a surface of the rotatable image heating member and forms a nip, between itself and the rotatable image heating member, in which a recording material for carrying an image is to be nip-conveyed, wherein the surface of the rotatable image heating member has a shape such that projections are distributed by the filler so that a coefficient of dynamic friction μ(hot) relative to said fixed pressing member when a surface temperature of the rotatable image heating member is a temperature during image heating and a coefficient of dynamic friction μ(cold) relative to the fixed pressing member when the surface temperature is a normal temperature satisfy, $$\mu(\text{hot})<1.2\times\mu(\text{cold}).$$

According to another aspect of the present invention, there is provided a rotatable image heating member for use with an image heating device, comprising:

an elastic layer;

a surface layer in which a filler is dispersed, wherein the surface of the rotatable image heating member has a shape such that projections are distributed by the filler so that a coefficient of dynamic friction μ(hot) relative to said fixed pressing member when a surface temperature of the rotatable image heating member is a temperature during image heating and a coefficient of dynamic friction μ(cold) relative to the fixed pressing member when the surface temperature is a normal temperature satisfy, $$\mu(\text{hot})<1.2\times\mu(\text{cold}).$$

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Part (a) of FIG. 1 is a schematic structural view of an image forming apparatus in Embodiment 1, and (b) of FIG. 1 is a schematic structural view of a fixing device.

Part (a) of FIG. 2 is a schematic sectional view for illustrating a surface layer of the fixing device, and (b) and (c) of FIG. 2 are schematic sectional views each for illustrating the form of a projection of a surface layer of the fixing roller.

Figure 3:
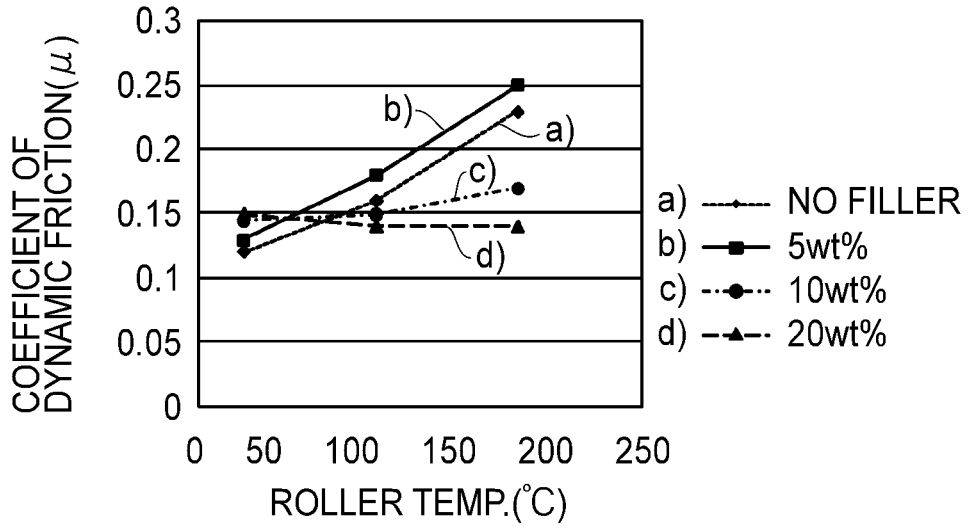
Figure 3:
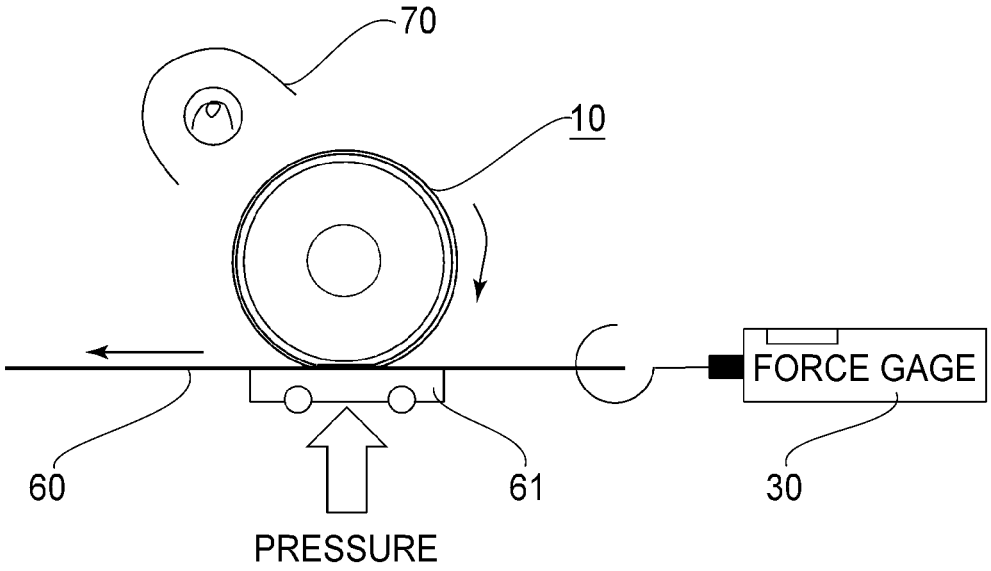

Part (a) of FIG. 3 is a graph for illustrating a change in coefficient of dynamic (kinetic) friction (dynamic friction coefficient) when the surface of the fixing roller is increased in temperature, and (b) of FIG. 3 is a schematic view for illustrating a measuring method of the dynamic friction coefficient.

Figure 4:
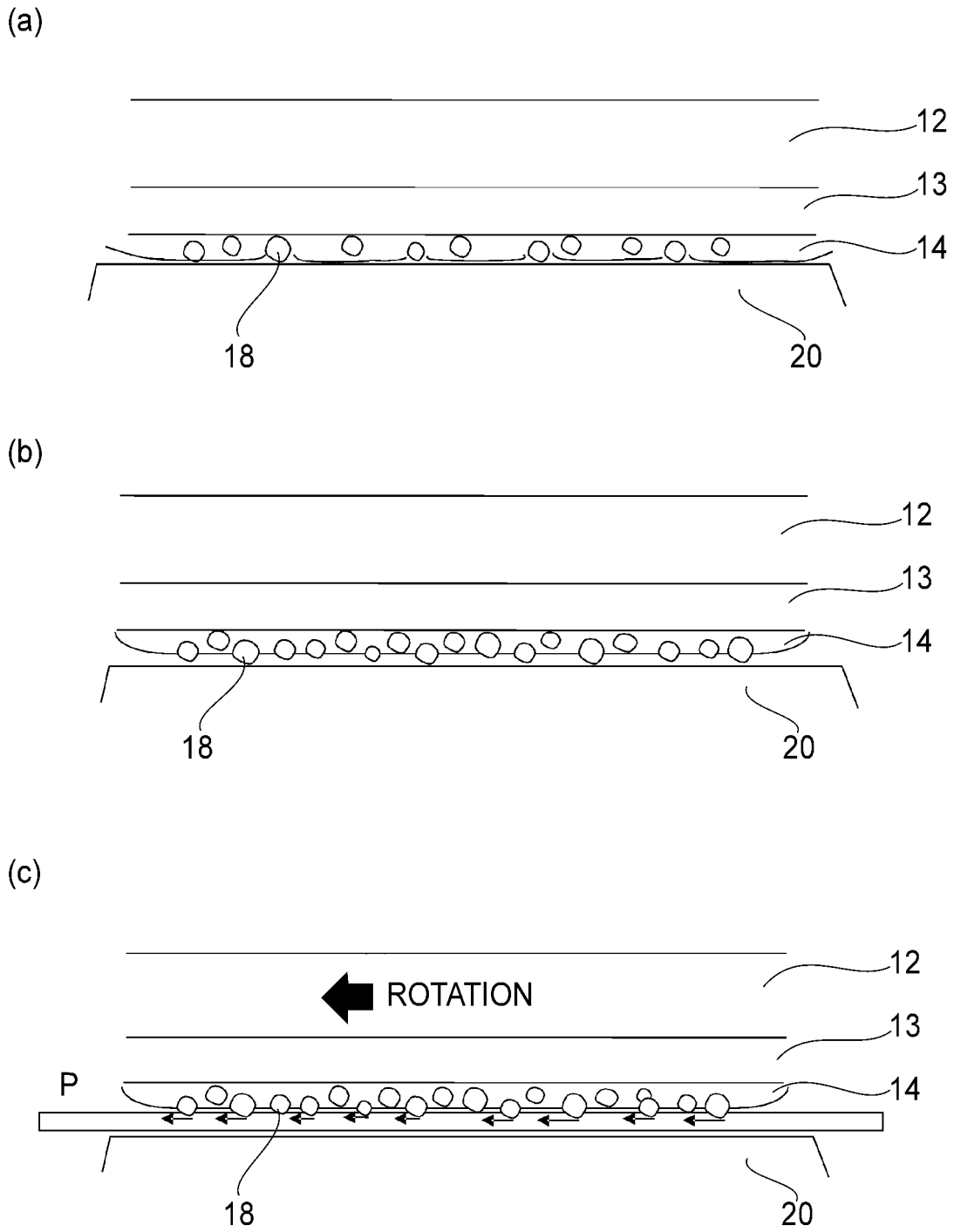

Parts (a), (b) and (c) of FIG. 4 are schematic sectional views for illustrating an effect of the present invention.

Figure 5:
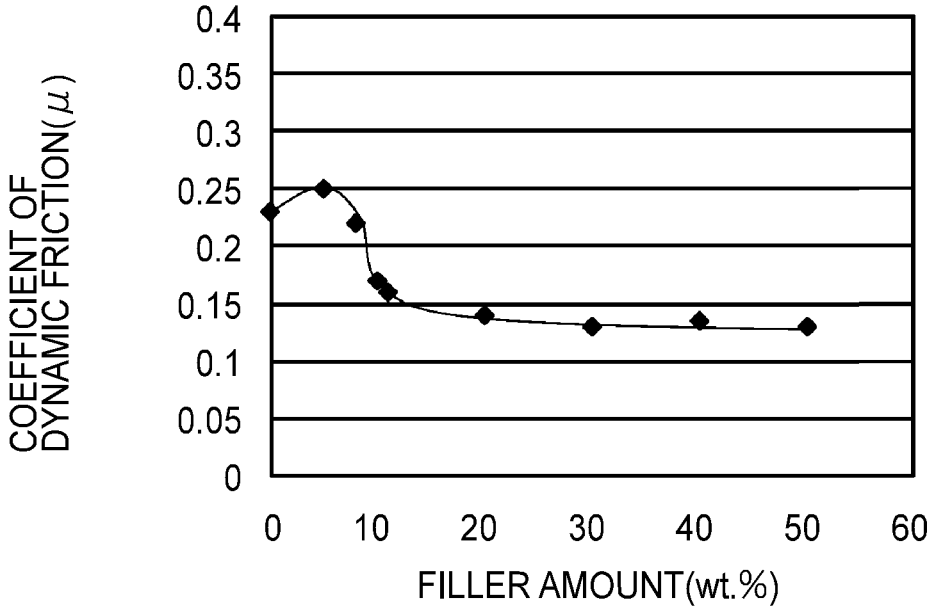
Figure 5:
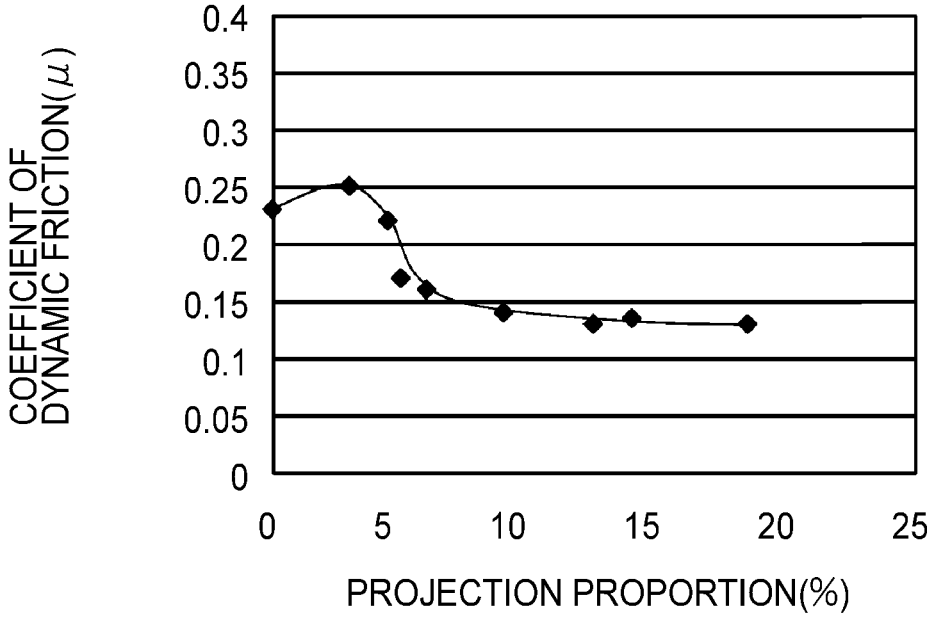

Parts (a) and (b) of FIG. 5 are graphs for illustrating the effect of the present invention.

Figure 6:
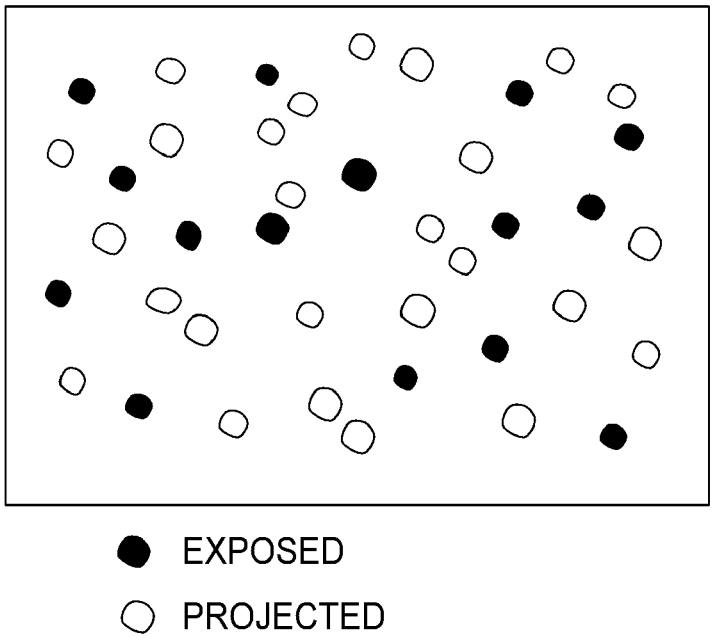
Figure 6:
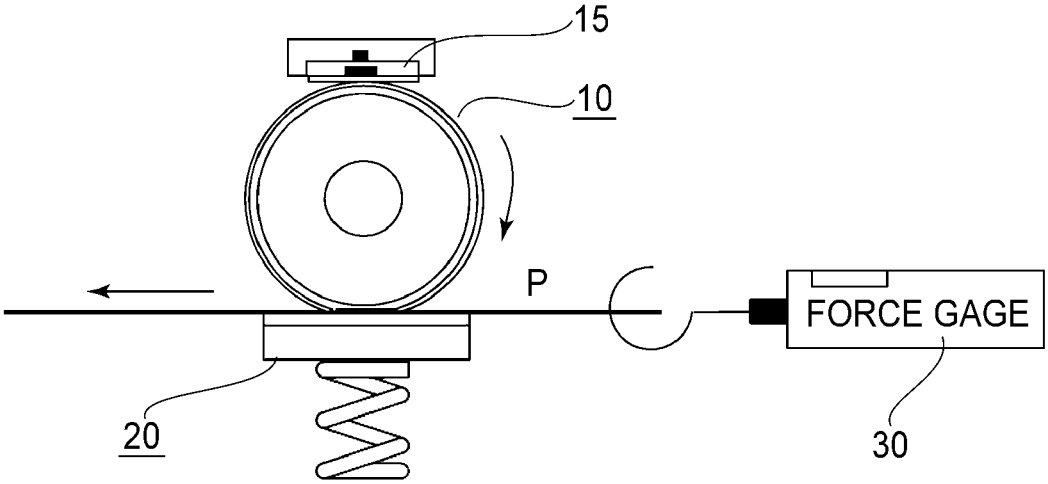

Part (a) of FIG. 6 is a schematic view for illustrating the fixing roller surface, and (b) of FIG. 6 is a schematic view for illustrating a measuring method of a recording material conveying force.

Figure 7:
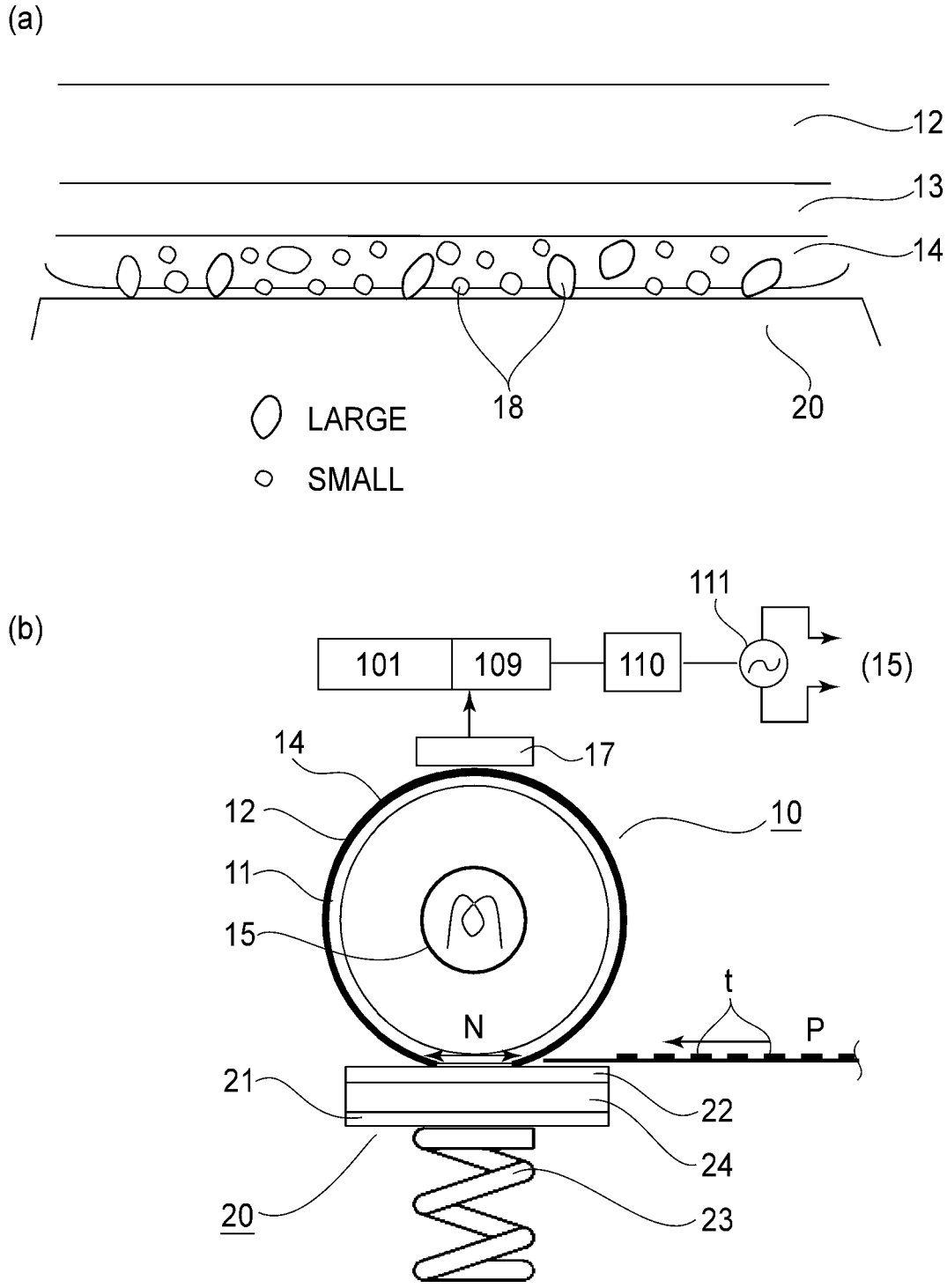

Part (a) of FIG. 7 is a schematic view for illustrating an effect in Embodiment 3, and (b) of FIG. 7 is a schematic view for illustrating an effect in Embodiment 4.

Figure 8:
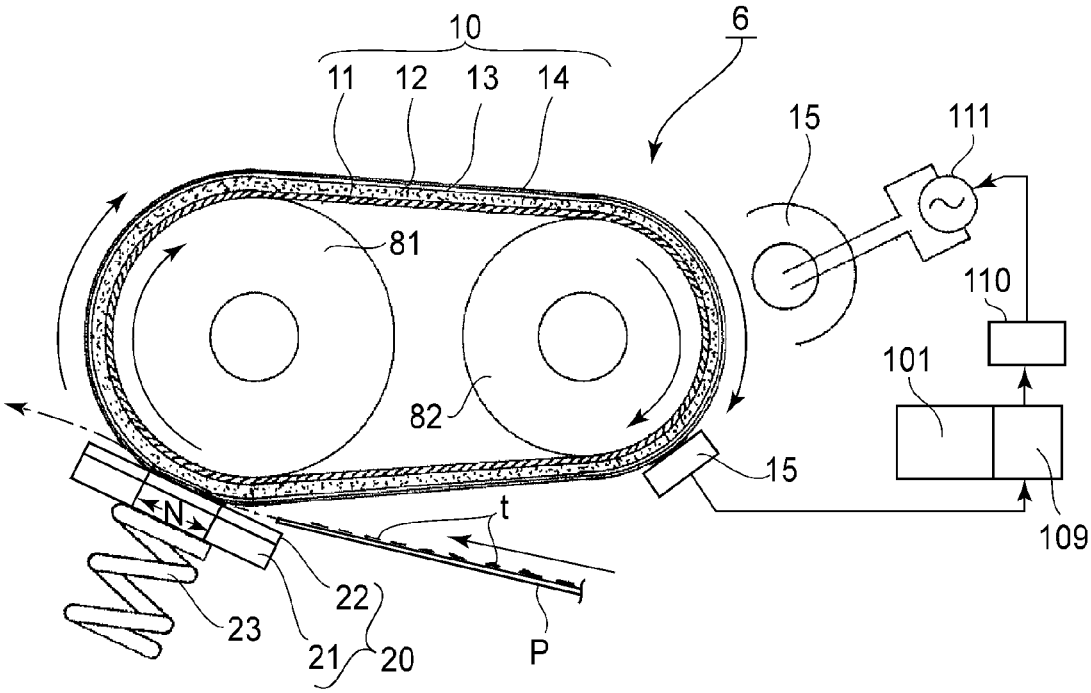

FIG. 8 is a schematic structural view of a fixing device of a fixing belt type.

DESCRIPTION OF THE PREFERRED EMBODIMENT

Embodiment 1

(1) Image Forming Apparatus

Figure 1:
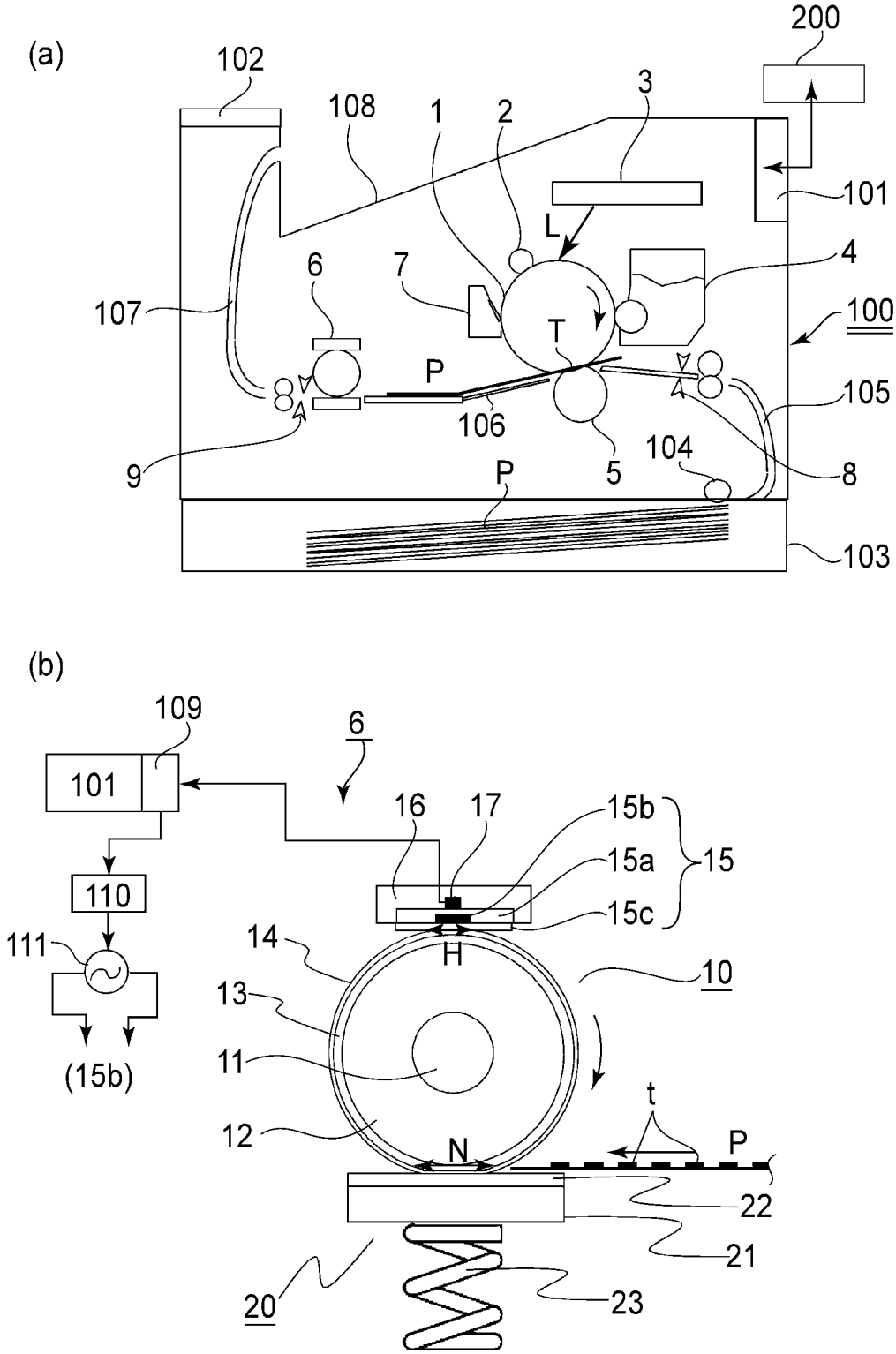

Part (a) of FIG. 1 is a schematic structural view of an example of an image forming apparatus 100 in which an image heating device according to the present invention is mounted as a fixing device (first heat-fixing device). This apparatus is a laser beam printer using an electrophotographic process of a transfer type. That is, an image is formed on a sheet-like pressing member P on the basis of an electric image signal inputted from a host device 200 such as a host computer or a network image reader to a controller 101 of the apparatus 100. The controller 101 transfers various pieces of electrical information between the host device 200 and an operating portion 102 of the apparatus 100. Further, controller 101 effect centralized control of an image forming operation of the apparatus 100 in accordance with a predetermined contact program or look-up table.

Inside the apparatus, a drum-like electrophotographic photosensitive member 1 as an image bearing member (hereinafter referred to as a drum) is provided. The drum 1 is prepared by forming a layer of a photosensitive material such as an OPC, amorphous Se or amorphous Si on a peripheral surface of a drum (cylinder)-like substrate of aluminum, nickel or the like. The drum 1 is rotationally driven at a predetermined speed (process speed) in the clockwise direction indicated by an arrow, so that the surface of the drum 1 is uniformly charged to a predetermined polarity and a predetermined potential by a charging roller 2 as a charging device. Then, the charged surface of the drum 1 is subjected to scanning exposure with a laser beam L, by a laser scanner 3 as an image exposure device, which is ON/OFF-modulated depending on the image information inputted from the host device 200 to the controller 101. As a result, an electrostatic latent image corresponding to a scanning exposure pattern is formed on the surface of the drum 1. The electrostatic latent image is visualized, as a toner image, with a developer (toner) by a developing device 4. As a developing method, a jumping developing method, a two-component developing method, FEED developing method or the like is used. In many cases, a combination of image exposure and a reverse developing method is used.

The toner image formed on the drum 1 is successively transferred onto the recording material P in a transfer nip T which is a contact portion between the drum 1 and a transfer roller 5 as a transfer device. Sheets of the recording material P are stacked and accommodated in a feeding cassette 103 and are fed one by one by driving a feeding roller 104 with predetermined control timing, and the fed recording material P is passed through a conveying path 105 and is introduced into the nip T. Here, a leading end of the recording material P is detected by a top sensor 8 provided close to the conveying path 105 so that an image forming position of the toner image on the drum 1 and a writing start position of a leading end of the recording material P are coincide with each other in the nip T, so that the recording material P is timed to writing start of the image on the drum 1. To the roller 5, a transfer bias which has an opposite polarity to a toner charge polarity and has a predetermined potential is applied from a transfer bias voltage source portion (not shown) during nip conveyance of the recording material P in the nip T. As a result, the toner image on the drum 1 surface is successively transferred onto the surface of the recording material P.

When the recording material P passes through the nip T, the recording material P is separated from the surface of the drum 1 and passed through a conveying path 106 to be introduced into a fixing device 6. Then the recording material P is heated and pressed, so that an unfixed toner image is fixed as a fixed image on the recording material P. The recording material P coming out of the fixing device 6 is passed through a conveying path 107 and is discharged as an image formed product on a discharge tray 108. Further, the drum surface after the recording material P is separated therefrom in the nip T is subjected to removal of a deposited residual matter such as untransferred toner by a cleaning device 7 and then is repetitively subjected to image formation. A sheet discharge sensor 9 is provided in the fixing device 6 and detects paper jam or the like when the recording material P causes the paper jam or the like between the top sensor 8 and the fixing device 6.

(2) Fixing Device 6

Part (b) of FIG. 1 is a schematic structural view of the fixing device 6 in this embodiment. The fixing device 6 is an image heating device of a pressing member-fixed type and an external heating type. The fixing device 6 includes a fixing roller 10, having an elastic layer, as a rotatable image heating member for heating the image on the recording material P. Further, the fixing device 6 includes a plate-like heater 15, as an external heating means for externally heating the fixing roller 10, contacted to an outer surface of the fixing roller 10 to form a heating nip H. Further, the fixing device 6 includes a non-rotational pressing member 20 (fixed type pressing member) which is fixed and is contacted to the outer surface of the fixing roller 10 to form the fixing nip N in which the recording material P is to be nip-conveyed. In this embodiment, the heater 15 and the pressing member 20 are disposed at 180-degree opposite positions while sandwiching the fixing roller 10.

1) Fixing Roller 10

The roller 10 is a roller member including the core metal 11 and includes a surface layer 14, of a fluorine-containing resin component, having the outer surface at which the filler is dispersed. At least one elastic layer, i.e., two layers 12 and 13 are formed in this embodiment between the core metal 11 and the surface layer 14. In the roller 10 in this embodiment, outside the core metal 11, a low heat conductive layer 12 formed with a low heat conductive silicone rubber (elastic layer) is provided. Further, outside the layer 12, a high heat conductive layer 13 formed in a thin film with a high heat conductive silicone rubber (elastic layer) and a parting layer 14 as an outermost layer (surface layer) are successively provided.

The low heat conductive elastic layer which is the low heat conductive layer 12 is formed of a silicone rubber composition in this embodiment. Specifically, the silicone rubber composition prepared by mixing 0.1-200 wt. parts of a hollow filler of 500 μm or less in average particle size into 100 wt. parts of a thermosetting organopolysiloxane composition is heat-cured to form the low heat conductive layer 12. Here, the hollow-filler includes a gas portion in a cured product to lower the thermal conductivity as in a sponge rubber and is formed with a microballoon material or the like. As such a material, it is possible to use any material such as glass balloon, silica balloon, carbon balloon, phenol balloon, acrylonitrile balloon, vinylidene chloride balloon, alumina balloon, zirconia balloon or Shirasu balloon. The low heat conductive has the functions of lowering thermal capacity of the entire elastic roller and insulating the heat from the heater 15 contacted to the roller 10 from the outside, to keep the roller surface temperature at a high level. When the roller surface is increased in temperature from a stand-by state (waiting state of the fixing device) up to a fixable temperature, the presence of the low heat conductive layer 12 increases a temperature rising speed, so that it becomes possible to reduce a waiting time until the rising of the heater 15.

The high heat conductive layer 13 is formed with a solid silicone rubber (solid elastic layer which is not foamed) and in which high heat conductive particles of metal oxides or ceramics such as alumina, aluminum nitride, SiC and zinc oxide are added. In this embodiment, alumina particles are used. The thermal conductivity of the high heat conductive layer 13 may preferably be increased as high as possible. In this embodiment, the high heat conductive layer 13 having the thermal conductivity of 1.5 W/mK is used. Further, with a large thickness of the high heat conductive layer 13, a heat accumulating effect is liable to be obtained. However, when the thickness is excessively large, the thermal capacity becomes large and therefore the roller temperature is not increased, so that a fixing efficiency is rather impaired. Further, the thickness of the high heat conductive layer 13. Further, the thickness of the high heat conductive layer 13 may desirably be changed depending on the conveying speed of the recording material P. This is because the thicknesses of the layers between which the heat is transferred vary depending on the conveying speed of the recording material P. According to a result of calculation by the present inventors, in the case where the conveying speed is slow, the heat present from the surface to a deeper portion of the high heat conductive layer contributes to the fixing. However, it has been found that only the heat accumulated at a lesser depth portion contributes to the fixing with a higher conveying speed. That is, in the case where the conveying speed of the recording material P is slow, the thickness of the high heat conductive layer 13 may be relatively thin and in the case where the layer with the thickness which is more than necessary is provided, the thermal capacity is increased and rather impairs the fixing efficiency. In this embodiment, the recording material conveying speed is about 130 mm/sec and an optimum thickness at this speed is about 150 μm. Further, an outer diameter of the roller 10 is 12 mm.

Here, the elastic layer of the roller 10 is, as described above, not necessarily required to include the two layers of the low heat conductive layer and the high heat conductive layer and it is also possible to employ such a constitution that a single solid rubber layer is provided in the case where there is no problem in terms of the rising time of the heater 15 or the heating efficiency of the recording material P. Further, there is also no problem even when a plurality of layers (two or more layers) are provided.

The surface layer (parting layer) 14 is formed of a fluorine-containing resin component in which the filler is dispersed. A projection is distributed and formed at the surface of the surface layer 14 in such a manner that at least a part of the filler is exposed from the surface layer surface or the filler is protruded. Further, with respect to a dynamic friction coefficient μ of the surface of the surface layer 14, when the dynamic friction coefficient μ(hot) at the time of increasing the surface temperature of the surface layer 14 to the temperature at which the image is to be heated and the dynamic friction coefficient μ(cold) at a normal temperature satisfy the relationship of: $\mu(hot)<1.2\times\mu(cold)$. With respect to the surface layer 14, detailed description will be made later in (4).

2) Heater 15

The heater 15 is formed in a plate-like shape with the low thermal capacity. The heater 15 includes an elongated substrate 15*a* such as an insulating ceramic substrate of aluminum, aluminum nitride or the like or a heat resistant resin substrate of polyimide, PPS, a liquid crystal polymer or the like. On the surface of the substrate 15*a*, along a longitudinal direction, an energization heat generating resistor layer 15*b* of Ag (silver)/Pd (paradium), $RuO_2$, $Ta_2N$ or the like is formed in the thickness of about 10 μm and the width of about 1-5 mm by screen printing or the like. Further, on the substrate 15*a*, a protective layer 15*c* for protecting the resistance layer 15*b* may be provided within a range of not impairing the heat efficiency. The thickness of the protective layer 15*c* may desirably be sufficiently thin to make the surface property good. As the protective layer 15*c*, it would be generally considered that a protective layer formed by glass coating or the like is used but is would be also considered that a fluorine-containing resin layer is used. As the material for the fluorine-containing resin layer, it is possible to use perfluoroalkoxy resin (PFA), polytetrafluoroethylene (PTFE), tetrafluoroethylene-hexafluoropropylene resin (FEP) and ethylene-tetrafluoroethylene resin (ETFE). Further, polychlorotrifluoroethylene resin (CTFE), polyvinylidene fluoride (PVDF) and the like may also be used. Further, it is also possible to coat an imide-based layer of polyimide, polyamideimide or the like in a single layer or in a mixed layer. Further, a dry coat lubricant of graphite, diamond-like carbon (DLC), molybdenum disulphide or the like may be used. Further, in the case where the substrate 15*a* is formed of aluminum nitride or the like which has good thermal conductivity, the energization heat generating resistance layer 15*b* may also be formed at an opposite side from the fixing roller 10 with respect to the substrate 15*a*.

A heat insulating stay holder 16 for holding the heater 15 is formed of the heat resistant resin material of the liquid crystal polymer, PPS, PEEK or the like. Further, the holder 16 is urged against the roller 10 by an urging means (not shown) such as an urging spring or the like, so that the surface of the heater 15 is press-contacted to the roller surface. As a result, between the heater 15 and the roller 10 surface, the heating nip H with a predetermined width (with respect to the rotational direction of the roller 10) in which the roller 10 is heated is formed. Further, between the heater 15 and the roller 10, a heat resistant sheet or the like (not shown) for protecting the heater surface or preventing deposition of a contaminant may be interposed.

3) Pressing Member 20

In this embodiment, the recording material 20 is a pad-like member (pressing pad). The pad 20 includes an elongated base material 21 extending in the longitudinal direction and a sliding layer 22 formed on the surface of the base material 21. The pad 20 is disposed opposed to the heater 15 with respect to a radial direction of the roller 10. Further, the longitudinal end portions of the base material 21 are held by a device frame (not shown) and the pad 20 is urged toward the roller 10 side by an urging spring 23 as a pressing means. By an urging force of the spring 23, the sliding layer 22 on the base material 21 is contacted to the surface of the roller 10 to deform the elastic layer 12, so that the nip N with the predetermined width (with respect to the rotational direction of the roller 19 is formed. The spring 23 has a coil spring shape and is disposed at three positions in total including positions in the neighborhood of the longitudinal end portions and central portion. As a result, the pad 20 can be urged against the roller 10 in a state in which bending is suppressed and therefore the nip N can be formed substantially uniformly. Incidentally, the pressure in this embodiment is 5 kgf in total (estimated for the heat-fixing device for an A4-sized recording material; 0.23 kgf/cm as the pressure per unit length). This value is lower than the pressure set in the conventional heat-fixing device of the host roller type or the film heating type. In this embodiment, the pressing member is of the fixed type (stationary type) and therefore it is desirable that the pressure is lowered as small as possible and thus the torque during the rotation of the roller 10 is decreased. Therefore, a proper range of the total pressure is 2 kgf to 10 kgf (0.09 kgf/cm to 0.45 kgf/cm).

The material for the sliding layer 22 may preferably have a sliding property such that the conveyance of the recording material P is not hindered, a parting property such that the toner or the like transferred from the recording material P is not deposited and an anti-wearing property such that the sliding layer 22 is not abraded by sliding with the recording material P. For that reason, as the material for the sliding layer 22, e.g., the fluorine-containing resin such as PTFE, FEP or PFA or other resins such as PAI (polyamideimide) or PI (polyimide) is used. On the other hand, the material for the base material 21 is not particularly limited so long as the material is suitable for formation and arrangement of the sliding layer 22. The material for the sliding layer 22 is also not limited to the materials described above. The base material 21 and the sliding layer 22 may be integrally provided.

(3) Fixing Operation of Fixing Device 6

The roller 10 is rotatably supported, at the end portions of the core metal 11, by the device frame (not shown) via bearing members. Further, the roller 10 is rotationally driven at a predetermined speed in the clockwise direction indicated by an arrow by driving a driving gear, by a rotationally driving system (not shown), provided at an end portion of the core metal 11. The roller 10 is rotated while sliding on the heater 15 in the nip H and on the pressing member 20 in the nip N. Further, a temperature controller 109 of the controller 101 turns on a triac element 110 as an energization driving means, so that energization to the resistance layer 15*b* from an AC power source 111 via an electrode portion (not shown) provided at the longitudinal end portion of the substrate 15*a* of the heater 15 is started. The resistance layer 15*b* generates heat by being supplied with electric energy, so that the heater 15 is increased in temperature. The temperature of the heater 15 is detected by a temperature detecting means 17 such as a thermistor provided on the other surface (back surface) of the substrate 15*a*. Detected temperature information is inputted into the temperature controller 109. The temperature controller 109 appropriately controls a duty ratio, wave number or the like of a voltage applied to the resistance layer 15*b* on the basis of the inputted detected temperature information, so that the heater 15 is kept at a predetermined temperature (target temperature). The roller 10 is (externally) heated in the nip H by the heat of the heater 15 from the outside, so that the roller surface is heated up to the temperature at which the toner can be fixed.

In this state, the recording material P on which the unfixed toner image t is formed is introduced into the nip N with the image surface toward the roller 10 side, so that the back surface side of the recording material P is contacted to the sliding layer 22 of the pressing member 20 and is nip-conveyed in the nip N while being slid on the surface of the sliding layer 22. During this nip-conveying process, the unfixed toner image t on the recording material P is fixed on the recording material surface as a fixed image by heat of the roller 10 and pressure in the nip N. The recording material P coming out of the nip N is separated from the roller 10 and then is conveyed for discharge. As another constitution of temperature control of the fixing device 6, the surface temperature of the roller 10 may also be kept at the predetermined temperature by controlling the energization to the resistance layer 15*b* of the heater 15 on the basis of a detection signal of the surface temperature of the roller 10 detected by the temperature detecting means.

(4) Constitution of Surface Layer (Parting Layer) of Roller 10

The structure, which is the feature, of the surface layer 14 of the roller 10 will be described below in detail. First, as the base material used in the surface layer 14, there is a need to contain the fluorine-containing resin component from the viewpoint of prevention of offset of the toner and contamination with the toner. For example, in addition to the fluorine-containing resin material such as PFA or FEP, a fluorine-containing rubber and a latex rubber containing the fluorine-containing resin such as PFA or FEP may be used as a suitable material. These materials may be used singly or in mixture of a plurality of materials as the base material. Further, an electroconductive material such as carbon black or the like is mixed into the base material, so that the surface layer can also be used as an electroconductive coating layer.

A coating liquid is prepared by mixing and dispersing, in a paint of the base material, an oxide filler of silica, alumina, zinc oxide, titanium oxide or the like or an inorganic filler of silicon carbide, boron nitride, aluminum nitride, silicon nitride or the like. In this embodiment, in view of a dispersibility in the base material paint or the like, alumina or silicon carbide was principally used as the filler. The coating liquid in which the filler is dispersed is uniformly applied onto the roller surface by a method such as spray coating or dipping. After the coating, the coated liquid is dried and then backed in an electric oven at about 300° C. for about 15 min. to form a film.

Incidentally, when the filler is dispersed in the base material paint, a predetermined surfactant or dispersant may be added. In the application step, it is desirable that the coating liquid is applied while being kept in a state in which the filler is uniformly dispersed in the mixture point. Depending on an amount and size of the filler, the mixture paint is required to be continuously stirred by a stirrer or the like so as not to settle in the paint.

Figure 2:
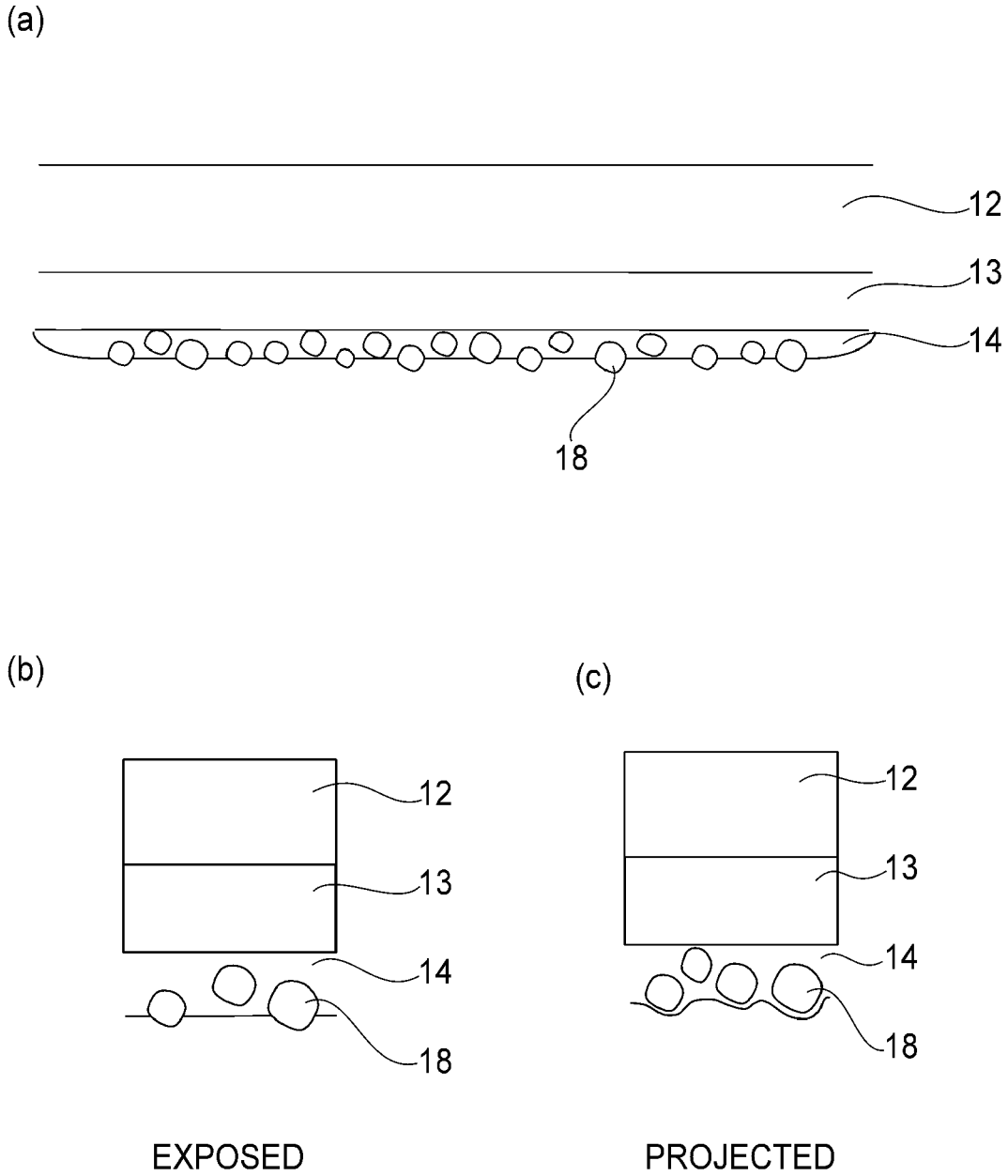

Part (a) of FIG. 2 is a schematic sectional view of the surface layer 14. There is a need that a filler 18 is dispersed in the fluorine-containing resin as the base material and a part of the filler 18 is protruded from the fluorine-containing resin surface. With respect to the protrusion of the filler 18, the state is not limited to the state as shown in (b) of FIG. 2 in which the surface of the filler 18 itself is exposed from the fluorine-containing resin surface 14 as it is. As shown in (c) of FIG. 2, a part or all of the filler 18 is coated with the fluorine-containing resin 14 so as to provide a protruded shape providing projections and recesses. That is, the roller 10 has a surface layer, at its outer peripheral surface, of the fluorine-containing resin component in which the filler 18 is dispersed. Further, at least a part of the filler 18 is exposed from the surface of the surface layer 14 or the surface is protruded by the filler 18, so that the filler 18 is distributed at the surface of the surface layer 14 to form the projections. That is, the projections formed by the exposed portion and protruded portion of the filler 18 are required to be distributed over the surface of the surface layer 14.

An optimum surface state for compatibly realizing a reduction in rotational torque of the roller 10 and a stable recording material conveying performance by the projections and recesses formed by the filler 18 will be described more specifically. In the case where the pad 20 which is the pressing member of the fixed type is used, in a state in which the roller 10 is rotated and the recording material P is not passed through the nip N, the roller 10 surface and the pad 20 surface are directly contacted and slid on each other, so that a frictional force of the sliding surface largely influences on the rotational torque. As a period of the state in which the roller 10 is rotated and the recording material P is not passed through the nip N, the period of pre-rotation (during pre-rotation operation) of the apparatus 100 until the recording material P is introduced into the nip N and the period of sheet intervals during continuous sheet passing may be included. Further, the period of post-rotation (post-rotation operation) of the apparatus 100 performed after a series of print operation steps may also be included. In order to rotate the roller 10 under a large frictional force, the rotational torque becomes high and therefore a motor with a large output for generating power therefor is required. Although the pressing member is fixed for reducing the cost and the size, when the output of the motor is increased, the cost is correspondingly increased, so that the motor size becomes large and an intended object cannot be achieved. When the frictional force can be suppressed to a low level, the torque is reduced naturally. The frictional force is determined by the dynamic friction coefficient μ of the surface of the roller 10 against the pressing member 20.

In the case where the fluorine-containing resin is used as the base material for the surface layer 14 of the roller 10, the dynamic friction coefficient μ of the surface of the roller 10 assumes the following behavior depending on the temperature. As shown in (a) of FIG. 3, in the cases of a) in which the filler 18 is not added to the base material for the surface layer 14, the dynamic friction coefficient μ is increased with surface temperature rise of the roller 10. This is attributable to a change of viscoelasticity of the fluorine-containing resin with temperature. When the viscoelasticity is decreased by surface temperature rise, the material is largely deformed when the force is applied from the outside. Actually, an elastic force for cancelling the deformation instantaneously acts on the material, so that a resistance force generates at the contact portion to result in a frictional force. That is, the roller 10 in which the filler 18 is not added into the surface layer 14 is increased in torque with temperature rise in a state in which the roller 10 is slid and rotated in direct contact to the pad 20. Further, in this state, even when the recording material (paper) P is introduced into the nip N, a force of the roller 10 for feeding the recording material P cannot largely overcome the resistance force exerted from the pad 20 on the recording material P, so that the recording material cannot be conveyed.

Here, measurement of the dynamic friction coefficient μ in the case where the surface temperature of the roller 10 was changed was performed by a method shown in (b) of FIG. 3. That is, a sliding sheet 60 is sandwiched between the roller 10 for measurement and a slidable pressing plate 61 which is molded with stainless steel, aluminum or the like. The pressing plate 61 is pressed against the roller 10 with predetermined pressure (e.g., 500 gf). The sliding sheet 60 may be SUS sheet or may be prepared by coating the fluorine-containing resin with a coating material or a tape material corresponding to the surface material of the pad 20 in the device 6 in (b) of FIG. 1. In this embodiment, the SUS sheet 60 surface-coated with a fluorine-containing resin (PTFE tape ("Scotch 5490", mfd. by 3M) was used. A force gage 30 is attached to an end portion of the sheet 60 and measures a force F for retaining the sheet 60 to be conveyed in a (leftward) direction indicated by an arrow when the roller 10 is rotated. The measured value F is divided by the pressure to be calculated as the dynamic friction coefficient μ. Further, the surface of the roller 10 is heated in a non-contact manner by a heat source such as a halogen heater 70 and then the dynamic friction coefficient μ when the surface temperature of the roller 10 is increased may be measured depending on the temperature.

Next, the case where the filler 18 is added to the surface layer 14 will be considered. Here, in the following description, the addition amount of the filler 18 is represented by weight percent (wt. %) which is a percentage of the filler 18 when the entire solid content (total solid) contained in the surface layer 14 after the film formation is 100 wt. %. Further, the particle size of the filler 18 is an average particle size. The filler particle size is measured by a laser diffractometry. A representative measuring device for the laser diffractometry may, e.g., be "Microtrac HRA" manufactured by Nikkaso Co., Ltd. When a particle size distribution obtained by the measurement is represented by a cumulation distribution, a particle size indicating a cumulative value of 50% is referred to as a median diameter (D50), which is used as the average particle size. The particle size distribution may also be measured by, in addition to the above-described diffractometry, a Coulter counter method or the like. The particle size distribution obtained by the definitive laser diffractometry or the Coulter counter method with respect to spherical and nonspherical particles does not reflect a shape factor of the filler such as spherical or nonspherical but is represented as a diameter of a spherical body having the same volume as the particles. Strictly, the shape of a needle-like (whisker) or flake-like filler is represented by an aspect ratio or the like but in the following, the filler particle size is described by using the average particle size.

As the filler 18, rounded particles of alumina of 4.0 μm in particle size were used. As shown by b) in (a) of FIG. 3, in the case where the addition amount of the filler 18 is 5 wt. %, the tendency that the dynamic friction coefficient μ is increased with the surface temperature rise of the roller 10 is similar to that in the case where there is no filler in a). This is because projections and recesses are formed at the roller surface by the addition of the filler but an adhesiveness between the surface of the roller 10 and the surface of the pad 20 is good in small addition amounts of the filler and therefore the frictional force between the surface of the roller 10 increased in resistance force by the lowering in viscoelasticity and the surface of the pad 20 closely contacted to the roller surface becomes large. In the case where the recording material P is passed in such a surface state, by the effect of the added filler 18, the conveying force is stronger than that in the case where no filler is present but the conveying force is still insufficient to continuously convey the recording material P stably.

On the other hand, as shown by d) in (a) of FIG. 3, in the case of the roller 10 in which the filler addition amount is 20 wt. %, the dynamic friction coefficient μ in a normal temperature state is somewhat increased but is not increased even when the surface temperature of the roller 10 is increased and remains at a substantially constant value. This is because even when the viscoelasticity of the fluorine-containing resin surface is lowered by the temperature rise as shown in (b) of FIG. 4, the presence of a large amount of the projections of the filler 18 which are interspersed can reduce a contact area between the surface of the roller 10 and the surface of the pad 20 to suppress the increase in frictional force That is, a rotational torque suppressing effect is obtained. In such a surface state, the recording material P is introduced into the nip N. Then, as shown in (c) of FIG. 4, the projections of the filler 18 present in the large amount in the interposed manner at the surface of the roller 10 firmly anchor to the recesses and projections of the recording material P, so that forces of the projections for pushing out the recording material P in the rotational direction of the roller 10 are joined together. The force exerted from the surface of the roller 10 on the recording material P is sufficiently larger than the resistance force exerted from the pad 20, so that stable recording material conveyance can be performed.

As described above, in order to compatibly realize the reduction in frictional force at the surface of the roller 10 and the improvement in conveying performance of the recording material P, there is a need to form many projections at the roller surface by adding the filler 18 in a sufficient amount. Part (a) of FIG. 5 shows a change in dynamic friction coefficient μ (T=180° C.) of the surface of the roller 10 when the addition amount of the filler 18 is increased at the roller 10 surface temperature of 180° C. The temperature of 180° C. is the temperature (image heating temperature) of the surface (of the surface layer 14) of the roller 10 during the image fixing operation of the fixing device 6. As shown in (a) of FIG. 5, the increase in dynamic friction coefficient μ is suppressed from the filler 18 addition amount of about 10 wt. % (or more). That is, it is understood that the addition amount of about 10% or more is effective in suppressing the increase in torque of the roller 10. Further, as is apparent from Table 1 appearing hereinafter, from the addition amount of about 10 wt. %, the conveying force of the recording material P is also started to be stabilized simultaneously with the torque suppression.

Here, the surface state for achieving a sufficient anchoring effect of the recording material P while reducing the contact area between the surface of the roller 10 and the pad 20 is important. When the amount of the filler 18 added to the surface layer 14, the amount of the projections provided by exposure or protrusion of the filler 18 is decreased but is increased by the addition of the filler 18 in a large amount. Part (a) of FIG. 6 is a schematic view of the surface of the roller 10 when the surface of the roller 10 is subjected to enlarged observation. Such an observation image is, e.g., obtained by taking an enlarged surface photograph with a magnification of 500-1000 by using an observation device such as a scanning electron microscope (SEM) or an optical microscope. For example, from the observation image, the projections of the filler 18 are selected to calculate the sum of projected areas thereof and the calculated sum of projected areas is divided by the sum of projected areas of the entire (whole) observation image, so that an occupied ratio (%) can be obtained.

Part (b) of FIG. 5 shows the change in dynamic friction coefficient obtained by replacing the addition amount of the filler 18 (the abscissa in (a) of FIG. 5) with the occupied ratio of the projections of the filler 18. From (b) of FIG. 5, it would be considered that the increase in dynamic friction coefficient μ can be suppressed when the occupied ratio of the projections of the filler 18 is about 5% or more (corresponding to about 10 wt. % or more of the filler addition amount).

Although details will be described later in a section of Comparative experiment, when the type, shape and particle size of the filler 18 are different, the addition amount of the filler 18 which is effective in compatibly realizing the reduction in torque and the increase in recording material conveying performance is also different. However, even in the case where the type, shape and particle size of the filler 18 are different, when the sum of projected areas of the filler 18 exceeds about 5% of that of the entire surface by adjustment of the addition amount, it was possible to confirm that the torque suppression and enhancement of the recording material conveying performance were compatibly realized.

Therefore, it is important that the surface property is controlled so as to provide the projections with the occupied ratio of 5% or more by the addition of the filler 18. However, when an observing method of the surface of the roller 10, a recognizing standard of the projections of the filler 18 and an observer are different, the size and number of identified projections are different, so that it cannot be concluded that the projections in the occupied ratio of 5% or more is uniquely effective. Therefore, the occupied ratio of the projections is an index for describing the surface state. Actually, at the time when the type, shape and particle size of the filler 18 used are determined, the torque, the dynamic friction coefficient μ and the conveying force of the recording material P during the heating are measured. Further, it is important to grasp the addition amount such that the increase in torque and dynamic friction coefficient μ due to the surface temperature rise of the roller 10 is not confirmed and a corresponding surface state.

In other words, the state in which the increase in torque and dynamic friction coefficient μ due to the surface temperature rise of the roller 10 is confirmed refers to a state in which a characteristic of the fluorine-containing resin as the base material dominantly influences the surface characteristic of the roller 10 and a characteristic of the filler 18 is not yet exhibited. Therefore, a sufficient recording material conveying force cannot be obtained. By increasing the addition amount of the filler 18, the characteristics of the filler and the projections formed by the filler become dominant, so that these characteristics bring about the effects of the torque suppression and stable recording material conveying force during the temperature rise. Therefore, by grasping the change in dynamic friction coefficient in the normal temperature state and temperature-increased state at the surface of the roller 10, it is possible to judge whether the surface characteristic of the roller 10 is dominant with respect to the base material characteristic or the filler characteristic.

By the method as represented by that shown in (a) of FIG. 3 described above, the dynamic friction coefficient μ is measured depending on the temperature of the roller 10. The dynamic friction coefficient μ at the normal temperature (e.g., 25° C.) is taken as μ(cold). Further, the dynamic friction coefficient μ when the surface temperature of the roller 10 is increased up to 180° C. (temperature for image heating) is taken as μ(hot). In order to suppress the torque, as shown in the graph of (a) of FIG. 3, the filler 18 in a sufficient amount (filler addition amount: 20 wt. %) may desirably be added so as to satisfy: μ(hot)=μ(cold) or μ(hot)<μ(cold).

When the factor which dominates the surface characteristic of the roller 10 is switched from the characteristic of the projections for the base material to that for the filler 18, in some cases, the relationship between μ(cold) and μ(hot) satisfy the above relationships. Further, in some cases, μ(hot) is slightly larger than μ(cold) to result in unstable value. The case where the filler addition amount is 10 wt. % as shown by c) in (a) of FIG. 3 corresponds to the latter cases. This would be considered because the surface characteristic is liable to slightly influenced correspondingly to the increase in surface area due to expansion or the like of the roller 10 by the heating. Further, that is attributable to a fluctuation, in dynamic friction coefficient μ with a certain range, due to dispersion non-uniformity of the filler 18 with respect to a circumferential direction of the roller 10, run out of the roller 10 itself and variation of a shaft axis. However, when the time of actual use of the roller 10 was taken into consideration, the recording material P could be stably conveyed by the effect of the projections of the filler 18, so that the increase in torque could also be suppressed. This will be described later in detail with reference to Table 1.

In consideration of these factors, when μ(hot)<1.2×μ(cold) is satisfied as a condition in which the effect of the present invention can be achieved, the surface characteristic of the roller 10 is dominantly influenced by the filler 18 and the projections formed by the filler 18. As a result, it is possible to realize the torque suppression and stable recording material conveying force during the use. Further, the dynamic friction coefficient μ(hot) during the temperature rise of the roller 10 is not limited to that at 180° C. but may also be that at the temperature at which the heat-fixing is effected. When abnormal temperature rise or the like at the end portion of the belt 10 during continuous sheet passing is also taken into consideration, there is no problem when the dynamic friction coefficient μ is measured at about 150° C. or more.

Further, when the amount of the added filler 18 becomes excessively large, a film-forming property of the surface layer 14 is lowered, so that the surface can be cracked after baking and the surface coating can be cracked by stress of sliding during the rotation of the roller 10. For that reason, the addition amount is adjusted in view of the type of the fluorine-containing resin material as the balloon and compatibility depending on the type and shape of the filler used.

Further, with respect to a relationship between the amount and size (outer diameter: average particle size) of the added filler, when the above-described protrusion of the filler 18 is taken into consideration, there is a need to adjust the relationship depending on the film thickness of the surface layer 14, i.e., the application (coating) amount. That is, in the case of a thick film thickness, by using a large filler 18, the filler 18 is liable to be protruded even in a small amount but is, when a smaller filler 18 is used, less liable to be protruded from the base surface unless the addition amount is increased. On the other hand, in the case of a thin film thickness, even a relatively small filler 18 can be protruded from the base surface but when the filler 18 is excessively large, a protrusion amount becomes excessively large, so that the filler 18 is liable to be separated from the base material during the use and it becomes difficult to achieve a desired function. The coating film thickness is influenced by factors such as the type of the fluorine-containing resin as the base material and the viscosity and coating conditions (spray amount and the number of coating, e.g., in spray coating) of the coating liquid and therefore these factors are required to be appropriately adjusted. Further, the shape of the filler 18 is also a factor which influences the conveying property of the recording material P and therefore there is a need to select an optimum shape depending on the purpose.

(5) Comparative Experiment

On the basis of the above-described viewpoints, effects with respect to the type of the base material and the amount, size and shape of the added filler 18 are compared with those in the conventional constitutions and will be described below.

I: Consideration of Addition Amount of Filler 18

A difference in effect depending on the addition amount of the filler 18 was checked. In this comparative experiment, perfluoroalkoxy resin (PFA) was used as the base resin material for the surface layer 14. In the case where PFA is used as the base material, the viscosity of the paint in which the filler 18 is added is low and therefore the film thickness of about 10 μm is optimum for the surface layer in order to obtain the surface property free from unevenness. The filler 18 used is rounded alumina particles (average particle size: 4 μm) of pulverization type. In the case where the entire surface layer 14 after the film formation is 100 wt. %, the coating liquid is prepared so that the weight % of the filler 18 is 0 wt. % to 50 wt. % and then is coated by spray coating, dried and subjected to a predetermined baking step to form a film. As described above, the addition amount of the filler 18 is represented as wt. % which is the occupied ratio (percentage) of the filler when the whole solid contained in the surface layer 14 after the film formation is taken as 100 wt. %. Further, the outer diameter of the roller 10 was 12 mm, and as the pressing member 20, a pad prepared by coating the aluminum metal plate 21 with the sliding layer 22 of PTFE as the fluorine-containing resin was used. The thus prepared roller 10 was mounted in the fixing device 6 and was subjected to measurement of the rotational torque on the roller shaft during the rotation and the conveying force during the recording material conveyance. The results are shown in Table 1.

TABLE 1

| EMB. NO.*1 | AA*2 (wt. %) | Torque (kgf · cm) | CF*4 (kgf) | PP*5 (%) | μ (180° C.) | μ (25° C.) | μ(180° C.)/ μ(25° C.) |
|---|---|---|---|---|---|---|---|
| CE 1 | 0 | 2.1 | <0.1 | 0 | 0.23 | 0.12 | 1.917 |
| CE 2 | 5 | 2.0 | 0.1 | 3.0 | 0.25 | 0.13 | 1.923 |
| EI-1 | 10 | 1.35 | 0.4 | 5.0 | 0.17 | 0.142 | 1.197 |
| EI-2 | 11 | 1.3 | 0.4 | 6.0 | 0.16 | 0.145 | 1.103 |
| EI-3 | 20 | 0.9 | 0.4 | 9.0 | 0.14 | 0.15 | 1.933 |
| EI-4 | 30 | 0.8 | 0.45 | 12.5 | 0.13 | 0.15 | 0.867 |
| EI-5 | 40 | 0.85 | 0.45 | 14.0 | 0.135 | 0.15 | 0.900 |
| CE 3 | 50 | UM*3 | UM*3 | 18.5 | 0.13 | 0.15 | 0.867 |

*1"CE" represents Comparative Embodiment and "E" represents Embodiment.

*2"A4" represents the addition amount.

*3"UM" represents the data is unmeasurable due to crack of the coating and a poor film forming property.

*4"CF" represents the conveying force.

*5"PP" represents a projection proportion.

The torque (kgf·cm) in Table 1 may desirably be, when a balance with the motor output of the fixing device 6 used in this embodiment is taken into consideration, about 1 kgf·cm. When the torque is increased to about 2.0 kgf·cm, the roller 10 cannot be rotated. When the torque is 1.4 kgf·cm or less, the roller 10 is rotatable by the driving force of the motor. Further, the conveying force (kgf) is a magnitude of a back tension required to stop conveyance of A4-sized plain paper (recording material) when the recording material is conveyed while being nipped in the nip N, and is measured by using a force gage 30 as shown in (b) of FIG. 6. In this embodiment, stable conveyance of the paper (recording material) becomes unstable unless the conveying force is 0.3 kgf or more.

Incidentally, a criterion of judgment of the recording material conveying force is not determined uniquely but a necessary value of the conveying force varies by the influences of a pressing force for the recording material P from the transfer portion upstream of the heat-fixing portion with respect to the recording material conveyance direction, the conveying force exerted on the sheet discharge portion and other auxiliary conveying members. The criterion of judgment of the recording material convey is determined depending on the image forming apparatus.

According to the comparative experiment with the results shown in Table 1, in order to obtain optimum torque and conveying force, the addition amount of the filler 18 is required to be those in Embodiments I-1 to I-5. When the film forming property is also taken into consideration, it can be said that the addition amount of 10 wt. % or more and 40 wt. % or less per the total weight of the surface layer 14 is optimum.

Further, in Table 1, the occupied ratio of the sum of projected areas of the projections of the filler 18 to that of the entire surface is indicated as the projection proportion. In Comparative Embodiment 2 in which a large torque value is measured, the occupied ratio is 3.0% and in Embodiment I-1 in which the torque is started to be suppressed, the occupied ratio is 5.0%. From this, it can be said that the occupied ratio of the projections is required to be set at about 5.0% or more by the addition of the filler 18 in order to suppress the torque.

Further, when the dynamic friction coefficient μ at the roller surface temperature of 180° C. is compared, it is understood that the torque is decreased with a decrease in dynamic friction coefficient μ (data of the dynamic friction coefficient μ in Table 1 correspond to those in the graph of FIG. 5). A ratio of the dynamic friction coefficient μ(180° C.) during the temperature rise of the roller 10 to the dynamic friction coefficient μ (25° C.9 at the normal temperature is μ(180° C.)/μ (25° C.)=1.197. In comparison of the dynamic friction coefficient μ, the dynamic friction coefficient μ at 180° C. (during temperature rise) is somewhat higher than that at 25° C. (normal temperature) but during the use in which the recording material P is conveyed, it is possible to compatibly realize the torque suppression and the stable recording material conveying force. That is, the surface state of the roller 10 in Embodiment I-1 can be said that the surface characteristic of the roller 10 is started to be changed from the characteristic of the fluorine-containing resin as the base material to the characteristic of the projections provided by the filler 18. That is, in the surface state in which the characteristic of the projections by the filler 18 is dominant as the surface characteristic, a relationship: μ(hot)<1.2×μ(cold) is satisfied.

II. Consideration of Particle Size of Filler 18

In the comparison in I described above, the influence of the difference in addition amount was considered when the average particle size of the added filler 18 was the same. In this comparison, the influence in the case where the particles of the filler 18 different in particle size are used will be considered. The fluorine-containing resin used as the base material and the coating film thickness are the same as those in I of (5). Similarly, the material for the filler 18 and the shape of the filler 18 are the same as those in I, i.e., the rounded alumina. Particles of the filler 18 providing the same coating film thickness of 10 μm and having different average particle sizes of 8 μm, 15 μm, 20 μm and 25 μm were added while changing the addition amount to form coated surface layers 14 and then the comparative experiment was conducted. The results are shown in Table 2.

TABLE 2

| EMB. NO.*1 | Base | TH*2 (μm) | FI*3 (μm) | AA*4 (wt. %) | Torque (kgf · cm) | CF*5 (kgf) | PP*8 (%) |
|---|---|---|---|---|---|---|---|
| CE 4 | PFA | 10 | 8 | 5 | 1.7 | 0.2 | 4.0 |
| E II-1 | PFA | 10 | 8 | 10 | 1.0 | 0.45 | 8.5 |
| E II-2 | PFA | 10 | 8 | 20 | 0.85 | 0.5 | 11.5 |
| E II-3 | PFA | 10 | 8 | 30 | 0.8 | 0.5 | 14.5 |
| CE 5 | PFA | 10 | 8 | 40 | UM1*6 | UM1*6 | — |
| CE 6 | PFA | 10 | 15 | 5 | 2.0 | 0.2 | 2.5 |
| CE 7 | PFA | 10 | 15 | 10 | 1.8 | 0.4 | 3.5 |
| E II-4 | PFA | 10 | 15 | 20 | 1.1 | 0.55 | 8.5 |
| E II-5 | PFA | 10 | 15 | 30 | 1.0 | 0.60 | 11.0 |
| CE 8 | PFA | 10 | 15 | 40 | UM1*6 | UM1*6 | — |
| E II-6 | PFA | 10 | 20 | 20 | 1.2 | 0.6 | 8.0 |
| E II-7 | PFA | 10 | 20 | 30 | 1.1 | 0.65 | 10.5 |
| CE 9 | PFA | 10 | 25 | 20 | UM2*7 | UM2*7 | — |

*1"CE" represents Comparative Embodiment and "E" represents Embodiment.
*2"TH" represents the film thickness.
*3"FI" represents the rounded alumina filler having the indicated average particle size.
*4"AA" represents the addition amount.
*5"CF" represents the conveying force.
*6"UM1" represents that the data is unmeasurable due to crack of the coating and a poor film forming property.
*7"UM2" represents that the data is unmeasurable since the filler is liable to be separated.
*8"PP" represents the projection proportion.

For example. in the case where the particle size of the filler 18 is 8 μm (Embodiment II-1 to II-3 in Table 2), even when the addition amount of the filler 18 is the same, there is a tendency that the torque is low compared with the case of the particle size of 4μ (Table 1). This means that the particle size is increased and even in a small addition amount, the filler is started to be protruded from the coating film surface. This can also be understood from the fact that the occupied ratio for the filler of 8 μm in particle size is larger than those for other fillers when the projection proportions of the fillers 18 in Table 2 are compared. For the same reason, there is a tendency that the recording material conveying force is somewhat increased. On the other hand, there is a tendency that the film forming property when the addition amount is increased becomes poor. The crack of the coating film starts to occur from the addition amount of about 40 wt. %. Therefore, in the case where the particle size is changed from 4 μm to o8 μm, an optimum addition amount is 10-30 wt. %.

Next, in the case where the filler 18 of 15μ in particle size larger than the film thickness of 10 μm (Embodiment II-4 and II-5), even when the filler addition amount is 10 wt. %, the decrease in torque is not caused. This means that a dispersion proportion of the filler with respect to the surface area is decreased due to the increase in filler diameter. That is, a site at which the filler itself is present is decreased and thus the occupied ratio of the projections of the filler 18 per the projected area of the entire surface is decreased to 3.5%. A smooth PFA surface is increased between the sites, so that the sliding area of the roller 10 with the pad 20 is increased and therefore the torque cannot be suppressed. The torque suppression and the conveying force increase can be expected by increasing the addition amount but there is the same tendency as in the case of the filler of 8 μm in particle size that the film forming property is impaired when the filler is excessively added. Therefore, when the filler 18 having the outer diameter (average particle size) larger than the film thickness is used, it is understood that the range of the addition amount in which the effect can be achieved is narrowed and the optimum addition amount is 20-30 wt. %. Further, although the data of the dynamic friction coefficient is omitted in Table 2, in a state in which the torque is effectively suppressed, the dynamic friction coefficient μ during the roller surface temperature rise was substantially equal to or less than that at the normal temperature.

Further, even in the case where the filler having a further large particle size of 20 μm is used, the compatible realization of the torque suppression and the recording material conveying force increase can be maintained in the filler addition amount of 20-30 wt. %. However, in the case where the filler having a still further large particle size of 25 μm is used, the filler 18 is liable to be separated from the coating film surface when the roller 10 is actually used, so that a desired effect cannot be achieved at a relatively early stage of continuous use. For that reason, the use of the filler having an excessively large particle size is undesirable.

From the above, in order to compatibly realize the torque suppression and the recording material conveying force increase, the optimum range is present depending on the film thickness of the surface layer 14 and it would be considered that the upper limit of the particle size of a usable filler is until about 200% of the film thickness.

On the other hand, with respect to the lower limit of the filler particle size with which the effect can be expected, e.g., as the filler having the particle size smaller than 4 μm for the filler used in the comparison of Table 1, the rounded fillers of 3 μm and 2μ in particle size were used for the adjustment of the addition amount. In both cases, the amount of the projections of the filler 18 was increased with an increase in addition amount, the effect of lowering the torque could be obtained. With respect to the recording material conveying force, when the filler of 3 μm is particle size is used, the conveying force of 0.32 kgf is obtained in the filler addition amount of 30 wt. %, so that the recording material can be conveyed. However, even when the filler addition amount is increased, with respect to the filler of 2 μm in particle size, the conveying force of 0.26 kgf is merely obtained, so that it was impossible to perform the stable recording material conveyance. This is because the filler particle size is excessively small and therefore the projections with a size sufficient to provide a necessary recording material conveying force cannot be formed. A similar result was also obtained with respect to particles of the filler 18 having different shapes described later.

As described above, the range of the average particle size of the filler 18 capable of achieving the effect of the present invention is 3 μm (lower limit) or more and 200% (upper limit) or less of the film thickness of the surface layer 14. Further, by using the filler 18 having a larger particle size within this range, an improvement in recording material conveying force is liable to expected and it is possible to obtain a stable recording material conveying property. Further, it was also found that the optimum filler addition amount varies depending on the particle size of the filler 18 used and these values are determined in consideration of the point at which the torque decrease and the necessary recording material conveying force can be compatibly realized and the limit of film formation.

The optimum addition amount of the filler 18 is determined from the preparation condition in this embodiment and therefore should be appropriately adjusted in the case where the film forming property is changed by changing the material used, the preparation condition of the coating liquid or the baking condition. That is, the filler addition amount is adjusted so as to be 10 wt. % or more and 40 wt. % or less in the case where the total solid is 100 wt. % and is also adjusted depending on the film thickness of the surface layer 14 and the average particle size of the filler 18.

III. Consideration of Shape of Filler 18

The influence of the shape of the filler will be described. With respect to the alumina filler having the rounded shape used in II, the effect was compared by using a spherical filler, a cubic (rectangular) pulverization filler and a flake-like filler. All the particles of the fillers have the average particle size of 8 μm and are added in the fixed addition amount of 20 wt. %. The base material and the film forming condition are the same as those in I and II.

The results are shown in Table 3,

TABLE 3

| EMB. NO.*1 | Base | TH*2 (μm) | FI*3 (type) | AA*4 (wt. %) | Torque (kgf · cm) | CF*5 (kgf) |
|---|---|---|---|---|---|---|
| E II-2 | PFA | 10 | A | 20 | 0.85 | 0.5 |
| E III-1 | PFA | 10 | B | 20 | 0.8 | 0.35 |
| E III-2 | PFA | 10 | C | 20 | 0.85 | 0.55 |
| E III-3 | PFA | 10 | D | 20 | 0.9 | 0.6 |

*1"CE" represents Comparative Embodiment and "E" represents Embodiment.

*2"TH" represents the film thickness.

*3"FI" represents the filler. "A" is the rounded alumina filler of 8 μm in particle size. "B is the spherical alumina filler of 8 μm in particle size. "C" is the cubic filler of 8 μm in particle size. "D" is the flake-like alumina filler of 8 μm in particle size.

*4"AA" represents the addition amount.

*5"CF" represents the conveying force.

As apparent from the Table 3, there is a tendency that the conveying force becomes small with the shape closer to the sphere and is increased with the different shape (nonspherical shape). When the filler shape is more different from the spherical, the amount of the projections protruded (projected) from the base surface of the surface layer 14 is liable to be increased and a degree of anchoring to the paper fiber due to the filler shape is increased and therefore it would be considered that the conveying force is increased by the increase in anchoring effect on the recording material P. With respect to the spherical filler 18, it would be considered that the amount of coating of the filler surface with the base material is large even when the filler is protruded from the base surface during the coating, and therefore the conveying force is weak since the roller is liable to be slid even when the roller slides on the recording material P.

When the comparison results described in I, II and III are totally considered, the particle size of the filler 18 may desirably be 3 μm or more and 200% or less of the film thickness of the surface layer 14. With respect to the filler shape, by using the different-shaped filler (nonspherical filler of the plate like, a needle (whisker) like, rectangular, cubic like, etc.) is used and by adjusting the addition amount in the range in which the film forming property is good, the torque decrease and the recording material conveying force improvement can be compatibly realized effectively. Here, it would be considered that a degree of achievement of the film forming property and the effect is changed depending on the base material used for the surface layer 14, a treating condition of the coating liquid after the filler dispersion, the coating, baking and drying conditions during the preparation of the surface layer 14, treatment of the primer layer provided between the surface layer 14 and the lower layer, and the like.

Depending on these conditions and constitutions, the filler addition amount, shape and the like should be appropriately optimized.

As described above, even in the case where the surface of the roller 10 is increased in temperature by heating or the like, when the increase in dynamic friction coefficient μ(hot) is suppressed in the state in which the projections of the filler 18 are distributed over the surface, the following effects can be obtained. That is, the projections and recesses distributed over the roller surface from the surface state to the extent that the contact area with the fixed type pressing member is decreased, with the result that the frictional force is decreased and thus the increase in torque can be suppressed. In addition, when the recording material is passed, the projections of the protruded filler sufficiently anchors to the recording material surface, so that it becomes possible to provide a stable paper (recording material) conveying force.

Embodiment 2

The constitutions of the image forming apparatus and heat-fixing device used in this embodiment are the same as those in Embodiment 1 and therefore will be omitted from the description. This embodiment is characterized by using, as the fluorine-containing resin component (base material) for the surface layer 14, a latex-type paint including a mixture of the fluorine-containing resin and a fluorine-containing rubber. Herein, the coating in which the fluorine-containing resin is dispersed in the fluorine-containing rubber is referred to as a fluorine-containing rubber latex coating unless otherwise specified.

As in Embodiment 1, in the case where the paint of the fluorine-containing resin alone is used as the base material, the (upper) limit of the film thickness of the coating capable of being formed in the film is generally about 15 μm. As described in Embodiment 1, the limit of the average particle size of the added filler depends on the film thickness and when the particle size is excessively increased, the filler is liable to be separated, so that such a problem that the surface property becomes coarse occurs. Therefore, in the case of the fluorine-containing resin-based material, the limit of the particle size of the usable filler is about 20-30 μm. Further, the addition amount in which the filler can be dispersed is about 30-40 wt. %, so that it is difficult to disperse the filler in a large amount.

On the other hand, it is difficult to form the film of the fluorine-containing rubber latex of 10 μm or less in film thickness and from the viewpoints of the viscosity and specific gravity of the coating liquid, the coating film thickness of about 20 μm to about 30 μm can easily be controlled in manufacturing. The increase in coating film thickness means that the particle size of the added filler can be increased. Further, by incorporating the fluorine-containing rubber component, the coating layer after the film formation has flexibility compared with the case of the fluorine-containing resin alone and therefore the crack due to the baking is also less liable to occur, so that it is easy to add the filler in a larger amount. That is, by using the fluorine-containing rubber latex coating as the base material for the surface layer 14, it becomes possible to extend the range of choices of the type and addition amount of the filler 18 to be added in the surface layer 14.

IV: Consideration of Difference in Base Material

A behavior in the case where the fluorine-containing rubber latex coating is used as the base material will be described with respect to the effect while be compared with that in Embodiment 1.

The fluorine-containing rubber latex coating specifically used as the base material for the surface layer 14 in this embodiment is a fluorine-containing rubber latex ("GLS213F", mfd. by Daikin Industries, Ltd.). The fluorine-containing resin component contained is FEP. In the fluorine-containing rubber latex (GLS213F), the filler in each of amounts indicated in Table 4 and a curing agent ("GL200B", mfd. by Daikin Industries, Ltd.) are mixed to prepare a coating liquid. The coating liquid is spray-coated on the fixing roller surface and is dried, followed by heating and baking at 300° C. for 15 minutes in an electric oven to obtain the fixing roller. In Embodiments IV-1 and IV-2, the rounded alumina filler of 10 μm in particle size was added in the addition amounts of 40 wt. % and 60 wt. %, respectively. In Embodiments IV-3, the rounded alumina filler of 30 μm in particle size was added in the addition amount of 30 wt. %.

The results are show in Table 4.

TABLE 4

| EMB. NO.*1 | Base | TH*2 (μm) | FI*3 (μm) | AA*4 (wt. %) | Torque (kgf · cm) | CF*5 (kgf) | PP*7 (%) |
|---|---|---|---|---|---|---|---|
| E II-3 | PFA | 10 | 8 | 30 | 0.8 | 0.5 | 14.0 |
| E II-4 | PFA | 10 | 15 | 30 | 1.0 | 0.6 | 11.0 |
| E IV-1 | GLS | 20 | 10 | 40 | 0.9 | 0.9 | 16.0 |
| E II-2 | GLS | 20 | 10 | 60 | 0.9 | 1.0 | 18.0 |
| CE 10 | GLS | 20 | 10 | 70 | UM*6 | UM*6 | — |
| E IV-3 | GLS | 20 | 30 | 30 | 0.9 | 1.1 | 15.5 |

*1"CE" represents Comparative Embodiment and "E" represents Embodiment.
*2"TH" represents the film thickness.
*3"FI" represents the rounded alumina filler having the indicated average particle size.
*4"AA" represents the addition amount.
*5"CF" represents the conveying force.
*6"UM" represents that the data is unmeasurable due to crack of the coating and a poor film forming property.
*7"PP" represents the projection proportion.

As is apparent from Table 4, when the fluorine-containing rubber latex coating is used, it becomes possible to further improve the recording material conveying force while maintaining the torque suppressing effect. This may attributable to the increase in occupied ratio of the projections of the filler 18 protruded from the surface layer 14 since the filler addition amount can be increased by the use of the latex coating as in Embodiment IV-1. Further, even when the addition amount of the filler 18 was increased up to 60 wt. % (Embodiment IV-2), a good surface layer was obtained without generating the crack or the like of the coating. When the filler addition amount is increased up to 70 wt. % as in Comparative Embodiment 10, the film forming property is impaired and therefore about 60 wt. % is the (upper) limit as the addition amount of the filler 18 which can be added.

Further, as in Embodiment IV-3, the fluorine-containing rubber latex coating can be applied in a large thickness up to 20 μm and therefore the filler 18 having a larger particle size (30 μm) can be used. As a result, the amount of protrusion of the filler 18 protruded from the surface layer 14 becomes large to enhance the recording material surface anchoring effect, so that it would be considered that the recording material can be conveyed further stably. Further, even in the case where the fluorine-containing rubber latex coating was used, with respect to the filler 18 having the particle size of less than 3 μm, it was unable to obtain the sufficient recording material conveying force. Further, in the case where the rounded alumina filler 18 of 40 μm in particle size was added with respect to the film thickness of 20 μm, the torque suppression and the recording material conveyance could be compatibly realized but in the case where the filler having the particle size more than 40 μm was added, the problem of the separation of the filler during the use occurred. Therefore, even when the type and thickness of the base material are changed, an applicable filler particle size is 3 μm (lower limit) or more and 200% (upper limit) or less of the film thickness. Further, in comparison in Table 4, the rounded filler 18 of the pulverization type is used but as described in Embodiment 1, when the different-shaped filler such as those of the nonspherical shape including the flake-like, the needle-like, the rectangular, the cubic, or the like shape, further improvement in conveying force can be expected.

The optimum addition amount of the filler 18 is determined from the preparation condition in this embodiment and therefore should be appropriately adjusted in the case where the film forming property is changed by changing the material used, the preparation condition of the coating liquid or the baking condition. That is, the filler addition amount is adjusted so as to be 10 wt. % or more and 60 wt. % or less in the case where the total solid is 100 wt. % and is also adjusted depending on the film thickness of the surface layer 14 and the average particle size of the filler 18.

Embodiment 3

In Embodiment 1 and Embodiment 2, a single species of the filler is added in the surface layer 14 but this embodiment is characterized in that two or more species of different fillers are added into the base material for the surface layer 14. In this embodiment, a constitution in which the fluorine-containing rubber latex coating is used as the base material will be described.

As described in Embodiment 2, in the constitution in which the fluorine-containing rubber latex coating is used as the base material, the coating can be coated in a large thickness. For that reason, by adding a filler 18 (one of the plural species of fillers) having a larger particle size (average particle size), it becomes possible to improve the recording material conveying force. However, when the addition amount of the filler 18 having the larger particle size is excessively large, the surface property of the roller 10 becomes coarse, so that the adhesiveness to the recording material is lowered. For that reason, the parting property itself is impaired, so that problems of a lowering in fixing property of the toner on the recording material, a lowering in level of offset and accumulation of the offset toner are caused to occur. In order to improve the surface property, it is possible to decrease the addition amount while sacrificing the conveying force but when the addition amount of the filler 18 having the larger particle size is decreased, an area in which there is no filler and the surface proper is good is increased. As a result, the degree of close contact between the pad 20 and the roller 10 surface is increased to result in the torque increase.

Therefore, in this embodiment, a smaller particle size filler is added while decreasing the addition amount of the larger particle size filler. As a result, as shown in (a) of FIG. 7, also in the area in which the larger particle size filler is not present, the smaller particle size filler is surface-exposed, so that the recording material conveying force can be maintained while suppressing the torque increase and it is possible to suppress the surface property of the flat surface portion at a level at which offset or the like does not occur.

V: Comparison Regarding Addition of Two or More Species of Fillers

The effect in the case where two species of fillers different in particle size and shape were added was compared. In Embodiment V-1, a flake-like alumina filler of 30 μm in particle size (major axis) was added as the larger diameter filler in the addition amount of 15 wt. % and a rounded alumina filler of 4 μm in particle size was added as the smaller diameter filler in the addition amount of 20 wt. %. That is, the filler 18 is constituted by the plural species of fillers. Of these fillers one filler has the average particle size larger than that of the other filler. Further, in Embodiment V-II, a cubic silicon carbide (SiC) filler of 15 μm in particle size (major axis) was added as the larger diameter filler in the addition amount of 15 wt. % and a rounded alumina filler of 4 μm in particle size was added as the smaller diameter filler in the addition amount of 25 wt. %. That is, the filler 18 is constituted by the plural species of fillers. Of these fillers, at least one species of fillers has the nonspherical shape such as the flake-like shape, the needle-like shape, the rectangular shape, the cubic shape or the like shape. The base material for the surface layer 14 is "GLS213F" similarly as in Embodiment 2, and the coating film thickness is also 20 μm. The results are shown in Table 5.

TABLE 5

| EMB. NO.*1 | FI*2 (type) | AA*3 (wt. %) | Torque (kgf · cm) | CF*4 (kgf) | Offset |
|---|---|---|---|---|---|
| E IV-2 | A | 30 | 0.9 | 1.0 | Δ |
| CE 11 | B | 30 | 0.9 | 1.3 | Δ |
| CE 12 | B | 15 | 1.7 | 1.0 | ○ |
| EV-1 | B | 15 | 0.85 | 1.2 | ○ |
| | C | 20 | | | |
| EV-2 | D | 15 | 0.88 | 1.1 | ○ |
| | C | 25 | | | |

*1"CE" represents Comparative Embodiment and "E" represents Embodiment.
*2"FI" represents the filler. "A" is the rounded alumina filler of 30 μm in particle size. "B" is the flake-like alumina filler of 30 μm in particle size. "C" is the rounded alumina filler of 4 μm in particle size. "D" is the cubic SiC filler of 15 μm in particle size.
*3"AA" represents the addition amount.
*4"CF" represents the conveying force.

In Table 5, the offset was evaluated at two levels. In the case where the offset was observed on the toner image after the fixing even when the amount thereof is slight, the level was "Δ", and in the case where the offset was not substantially observed by eyes, the level was "○". As represented by Embodiment IV-2 and Comparative Embodiment 11, in the case where the single filler having a relatively large particle size is added in a large addition amount, the surface property becomes coarse and thus the offset becomes conspicuous. When the addition amount is decreased, as in Comparative Embodiment, the surface property is improved but the smooth surface area is increased correspondingly to a decrease in site in which the filler is present, with the result that the frictional force becomes large and thus the torque is increased.

On the other hand, as in Embodiments V-1 and V-2, by the addition of the smaller diameter filler while decreasing the addition amount of the larger diameter filler, it becomes possible to suppress the torque while maintaining the necessary conveying force and to suppress the roughness of the flat surface portion to a tolerable level of the offset. That is, the larger diameter filler functions as the filler for providing the stable conveying force, and the smaller diameter filler has the function of suppressing the torque and the lowering in surface property. Thus, by effectively using the functions of the fillers different in types for different purposes, it becomes possible to improve a necessary characteristic as the roller.

Further, the filler of alumina or the like has a high heat conduction property and therefore the smaller diameter filler particles added among the larger diameter filler particles also have the function of improving the heat conductivity of the surface layer, thus being advantageous in that the control temperature at which the toner on the recording material is fixed can be lowered.

Incidentally, the combinations of the type, the particle size, the shape and the like of the plural species of the fillers to be added are not limited to the combination of the larger diameter filler and the smaller diameter filler shown in Table 5. The combination should be appropriately optimized depending on the characteristic of the fixing device used, by using the particle size, the shape, the material and the like of the filler 18 in combination. For the purpose of improving the recording material conveying force and torque varying due to the friction and improving the characteristics such as the parting property, the heat conductivity and the like depending on the surface property, the combination may be optimized so as to improve the characteristic, compared with that of the conventional constitution using the single filler, by combining the plurality of fillers. Further, the fluorine-containing resin as the base material is also not limited to the fluorine-containing rubber latex coating but may also be the fluorine-containing resin such as PFA or FES used in Embodiment 1.

Other Embodiments (1) In the fixing device 6 in Embodiments 1 to 3, the heating means 15 for externally heating the roller 10 is not limited to the plate-like heater 15 for heating the roller 10 in contact with the outer surface of the roller 10. The heating means 15 may also be a heat roller rotating in contact with the outer surface of the roller 10 and may be a halogen lamp or an infrared heater provided opposed to and in non-contact with the outer surface of the roller 10. Further, the layer constituting the roller 10 may be provided with the energization heat generating resistor layer as the heating means. It is also possible to employ a constitution in which the layer constituting the roller 10 is provided with an electromagnetic induction heat generating layer and an exciting coil for generating AC magnetic flux acting on the heat generating layer is provided outside or inside the roller 10.

(2) The heating method of the roller 10 is not limited to the external heating method but may also be an internal heating method as shown in (b) of FIG. 7. The fixing device shown in (b) of FIG. 7 has a constitution in which the core metal 11 of the roller 10 is formed with a hollow member in which the heat source such as the halogen heater is inserted as the heating means 15 to heat the roller 10 from the inside of the roller 10. In this constitution, on the peripheral surface of the hollow roller core metal member 11, the surface layer 14 is formed directly or via the elastic layer with a predetermined thickness. Further, when the surface layer 14 has the constitution as described in Embodiments 1 to 3, it becomes possible to suppress the torque against the sliding with the fixed type pressing member 20 and to provide the stable paper (recording material) conveying force even during the passing of the recording material P. In this internal heating method, when the elastic layer 12 of the roller 10 is formed in an excessively large thickness, the rising time of the roller 10 is increased and in addition, it becomes impossible to efficiently transfer thermal energy from the heating means 15 provided inside the roller 10. Therefore, the elastic layer 12 is not provided or is formed in a small thickness as thin as possible. In this case, when the pressing member 20 is a rigid member, it becomes difficult to form the nip N necessary for the fixing. For that reason, the constitution of the pressing member (pressing pad) 20 is, e.g., such that the parting layer 22 of PFA, PTFE or the like is provided on the elastic layer 23 formed with the heat resistant rubber such as the silicone rubber on the base material 21 to facilitate formation of the nip N with the predetermined width. The temperature control of the roller 10 is effected in the following manner. The surface temperature of the roller 10 internally heated by heat generation of the heat source 15 supplied with electric energy from an AC power source 111 is detected by a temperature detecting means 17 such as a thermistor or the like provided in contact or non-contact with the surface of the roller 10. The detected temperature information is inputted into the temperature controller 109. The temperature controller 109 controls the energization driving means 110 on the basis of the detected temperature information. That is, by controlling the power supplied from the heating means 15 to the heat source 15, the surface temperature of the roller 10 is controlled at a predetermined fixing temperature. In addition to the heating constitution of the roller 10, it is also possible to appropriately employ other constitutions such as an electromagnetic induction heating constitution and a constitution in which the energization heat generating resistor layer is formed on the roller itself by lamination.

(3) The rotatable image heating member 10 is not limited to the roller but may also be a flexible endless belt. FIG. 8 is a schematic view showing an example of the external heating type fixing device 6 in which the flexible endless belt is used as the rotatable image heating member 10. The flexible endless belt 10 as the rotatable image heating member is a lamination belt including, from the inside to the outside, a flexible substrate layer 11, a low heat conductive layer (elastic layer) 12, a high heat conductive layer (elastic layer) 13 and a surface layer (parting layer) 14 and has flexibility as a whole. The belt 10 is extended and stretched between a driving roller 81 and a tension roller 82 and is rotationally driven by the roller 81 in the clockwise direction indicated by an arrow. Further, at the belt contact portion of the roller 81, a fixed non-rotational pressing member (pressing pad) 20 for nip-conveying the recording material P in press-contact with the outer surface of the belt 10 is provided. The outer surface of the belt 10 is externally heated to a predetermined image heating temperature by the halogen lamp 15 as the heating means provided opposed to and in non-contact with the outer surface of the belt 10. Further, when the surface layer 14 of the belt 10 has the constitution as described in Embodiments 1 to 3, the torque can be suppressed against the sliding with the fixed type pressing member 20 and the stable conveying force can be provided even during the passing of the recording material P. The temperature T control of the belt 10 is effected in the following manner. The surface temperature of the belt 10 externally heated by heat generation of the lamp 15 supplied with electric energy from an AC power source 111 is detected by a temperature detecting means 17 such as a thermistor or the like provided in contact or non-contact with the surface of the belt 10. The detected temperature information is inputted into the temperature controller 109. The temperature controller 109 controls the energization driving means 110 on the basis of the detected temperature information. That is, by controlling the power supplied from the power source 111 to the lamp 15, the surface temperature of the belt 10 is controlled at a predetermined fixing temperature. In addition to the heating constitution of the belt 10, it is also possible to appropriately employ other constitutions such as an electromagnetic induction heating constitution and a constitution in which the energization heat generating resistor layer is formed on the belt itself by lamination.

(4) The fixed type pressing member 10 is not limited to the pressing pad but may also be a pressing sheet or a sheet-like pressing member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 169159/2010 filed Jul. 28, 2010 which is hereby incorporated by reference.

What is claimed is:

1. An image heating device comprising:

a rotatable image heating member including an elastic layer and a surface layer in which a filler is dispersed; and a fixed pressing member which is contacted to a surface of said rotatable image heating member and forms a nip, between itself and said rotatable image heating member, in which a recording material for carrying an image is to be nip-conveyed, wherein the surface of said rotatable image heating member has a shape such that projections are distributed by the filler so that a coefficient of dynamic friction, μ(hot), of the surface of said rotatable image heating member when a surface temperature of said rotatable image heating member is a temperature during image heating and a coefficient of dynamic friction, μ(cold), of the surface of said rotatable image heating member when the surface temperature is 25° C. satisfy, $$\mu(\text{hot})<1.2\times\mu(\text{cold}).$$

2. A device according to claim 1, wherein the filler has an average particle size of 3 μm or more and is 200% or less of a thickness of the surface layer.

3. A device according to claim 1, wherein the filler includes a plurality of types of fillers different in average particle size.

4. A device according to claim 1, wherein the filler includes a plurality of types of fillers including at least one species of a nonspherical filler.

5. A device according to claim 1, wherein the surface layer is a fluorine containing resin layer, and an addition amount of the filler is 10 wt. % or more and 40 wt. % or less when a total solid of the surface layer is 100 wt. %.

6. A device according to claim 1, wherein the surface layer is a fluorine containing rubber latex layer, and an addition amount of the filler is 10 wt. % or more and 60 wt. % or less when a total solid of the surface layer is 100 wt. %.

7. A device according to claim 1, further comprising a heating member for heating said rotatable image heating member from a surface side thereof.

8. A rotatable image heating member for use with an image heating device, comprising:

an elastic layer; and a surface layer in which a filler is dispersed, wherein the surface of said rotatable image heating member has a shape such that projections are distributed by the filer so that a coefficient of dynamic friction, μ(hot), of the surface of said rotatable image heating member when a surface temperature of said rotatable image heating member is a temperature during image heating and a coefficient of dynamic friction, μ(cold), of the surface said rotatable image heating member when the surface temperature is 25° C. satisfy, $$\mu(\text{hot})<1.2\times\mu(\text{cold}).$$

9. A member according to claim 8, wherein the filler has an average particle size of 3 μm or more and is 200% or less of a thickness of the surface layer.

10. A member according to claim 8, wherein the filler includes a plurality of types of fillers different in average particle size.

11. A member according to claim 8, wherein the filler includes a plurality of types of fillers including at least one species of a nonspherical filler.

12. A member according to claim 8, wherein the surface layer is a fluorine containing resin layer, and an addition amount of the filler is 10 wt. % or more and 40 wt. % or less when a total solid of the surface layer is 100 wt. %.

13. A member according to claim 8, wherein the surface layer is a fluorine containing rubber latex layer, and an addition amount of the filler is 10 wt. % or more and 60 wt. % or less when a total solid of the surface layer is 100 wt. %.

14. A member according to claim 8, wherein said elastic layer includes a low heat conductive layer and a high heat conductive layer.

* * * * *